US006971125B2

(12) United States Patent
Mattson, Jr. et al.

(10) Patent No.: US 6,971,125 B2
(45) Date of Patent: Dec. 6, 2005

(54) ANTIMICROBIAL WHIRLPOOL BATHTUB

(76) Inventors: Roy W. Mattson, Jr., 1732 Spencer St., Longmont, CO (US) 80501; Paulette C. Ogden, 1732 Spencer St., Longmont, CO (US) 80501; Philip I. Ogden, 1732 Spencer St., Longmont, CO (US) 80501

( * ) Notice: Subject to any disclaimer, the term of this patent is extended or adjusted under 35 U.S.C. 154(b) by 0 days.

(21) Appl. No.: 11/114,844

(22) Filed: Apr. 26, 2005

(65) Prior Publication Data

US 2005/0183199 A1 Aug. 25, 2005

Related U.S. Application Data

(60) Continuation of application No. 10/841,925, filed on May 7, 2004, which is a division of application No. 10/211,497, filed on Aug. 2, 2002, now Pat. No. 6,760,931.

(51) Int. Cl.[7] ..... A47K 3/00; A47K 3/01

(52) U.S. Cl. ..... 4/541.1; 4/507; 4/509; 210/169

(58) Field of Search ..... 4/490, 504, 507, 4/509, 538, 541.1–541.3, 584; 210/169, 749, 210/416.2, 755, 764; 137/268; 422/247, 422/275, 261–264, 281

(56) References Cited

U.S. PATENT DOCUMENTS

| | | | |
|---|---|---|---|
| 148,288 | A | 3/1874 | Edgar |
| 206,938 | A | 8/1878 | Emory |
| 553,383 | A | 1/1896 | Bailey |
| 828,716 | A | 8/1906 | Craig |
| 1,284,615 | A | 11/1918 | Delely |
| 1,428,618 | A | 9/1922 | Wagner |
| 2,073,784 | A | 3/1937 | Day |
| 2,194,056 | A | 5/1940 | Quagk |
| 2,204,898 | A | 6/1940 | Lee |
| 2,247,116 | A | 6/1941 | Day |
| 2,329,987 | A | 9/1943 | Goodloe |
| 2,367,794 | A | 1/1945 | Marselus |
| 2,552,709 | A | 5/1957 | Clements |
| 2,709,489 | A | 5/1958 | Keebler |
| 3,027,391 | A | 3/1962 | Selri |
| 3,198,726 | A | 8/1965 | Triklis |
| 3,263,811 | A | 8/1966 | Bakes et al. |
| 3,294,680 | A | 12/1966 | Lancy |
| 3,385,445 | A | 5/1968 | Bochegger et al. |
| 3,422,183 | A | 1/1969 | Ellison |
| 3,426,901 | A | 2/1969 | Sherper |
| 3,575,853 | A | 4/1971 | Gaughan |
| 3,615,294 | A | 10/1971 | Long |
| 3,697,567 | A | 10/1972 | Taylor, Jr. |
| 3,702,298 | A | 11/1972 | Solaos Jr. et al. |
| 3,766,036 | A | 10/1973 | McKarntey |
| 3,788,982 | A | 1/1974 | Soldos |

(Continued)

FOREIGN PATENT DOCUMENTS

DE 199 61049 A1 6/2001

(Continued)

OTHER PUBLICATIONS

U.S. Appl. No. 10/459,665, filed Jun. 11, 2003, Selover (Continued)

*Primary Examiner*—Tuan Nguyen
(74) *Attorney, Agent, or Firm*—Faegre & Benson, LLP

(57) ABSTRACT

A method to make a whirlpool bathtub where bacteria growth is inhibited or bacteria is reduced, after tub drain down and between electrical system activation.

10 Claims, 23 Drawing Sheets

U.S. PATENT DOCUMENTS

| | | | |
|---|---|---|---|
| 3,802,910 | A | 4/1974 | Geron |
| 3,839,202 | A | 10/1974 | Roy |
| 3,857,704 | A | 12/1974 | Coulter |
| 3,873,581 | A | 3/1975 | Fitzpatrick |
| 3,905,827 | A | 9/1975 | Goffredo |
| 3,922,224 | A | 11/1975 | Lewandowski |
| 3,933,635 | A | 1/1976 | Marchant |
| 3,976,571 | A | 8/1976 | Rio |
| 3,989,623 | A | 11/1976 | Neal |
| 4,005,011 | A | 1/1977 | Sweeny |
| 4,026,797 | A | 5/1977 | Nikolic |
| 4,028,236 | A | 6/1977 | Townsend |
| 4,052,318 | A | 10/1977 | Krebs |
| 4,053,403 | A | 10/1977 | Beachgoer et al. |
| 4,078,040 | A | 3/1978 | Milkov |
| 4,094,777 | A | 6/1978 | Sugier |
| 4,108,770 | A | 8/1978 | Roy |
| 4,180,473 | A | 12/1979 | Maurer et al. |
| 4,219,419 | A | 8/1980 | Sweeny |
| 4,233,694 | A | 11/1980 | Janosko et al. |
| 4,241,025 | A | 12/1980 | Grayson et al. |
| 4,257,893 | A | 3/1981 | Burton |
| 4,303,441 | A | 12/1981 | Lamisse |
| 4,309,992 | A | 1/1982 | Dodak et al. |
| 4,337,136 | A | 6/1982 | Dahlgren |
| 4,340,039 | A | 7/1982 | Hibbard et al. |
| 4,340,982 | A | 7/1982 | Hart et al. |
| 4,349,434 | A | 9/1982 | Jaworski |
| 4,359,790 | A | 11/1982 | Chalberg |
| 4,382,865 | A | 5/1983 | Sweeny |
| 4,385,969 | A | 5/1983 | Margolis |
| 4,414,115 | A | 11/1983 | The |
| 4,416,854 | A | 11/1983 | Nielsen |
| 4,420,463 | A | 12/1983 | Pocius et al. |
| 4,421,652 | A | 12/1983 | Heskett |
| 4,426,286 | A | 1/1984 | Puckett et al. |
| 4,504,387 | A | 3/1985 | LeMire et al. |
| 4,519,914 | A | 5/1985 | Etani |
| 4,533,476 | A | 8/1985 | Watkins |
| 4,552,658 | A | 11/1985 | Adcock et al. |
| 4,584,106 | A | 4/1986 | Held |
| 4,610,783 | A | 9/1986 | Hudson |
| 4,630,634 | A | 12/1986 | Sasaki et al. |
| 4,637,873 | A | 1/1987 | DeSousa et al. |
| 4,676,894 | A | 6/1987 | Diamond et al. |
| 4,692,314 | A | 9/1987 | Etani |
| 4,761,208 | A | 8/1988 | Gram et al. |
| 8,798,339 | | 9/1988 | Perry et al. |
| 4,780,197 | A | 10/1988 | Schuman |
| 4,798,028 | A | 1/1989 | Pinion |
| 4,816,177 | A | 3/1989 | Nelson et al. |
| 4,817,214 | A | 4/1989 | Stuessy |
| 4,818,389 | A | 4/1989 | Tobias et al. |
| 4,857,112 | A | 8/1989 | Franninge |
| 4,867,196 | A | 9/1989 | Zetena et al. |
| 4,871,710 | A | 10/1989 | Denny |
| 4,876,003 | A | 10/1989 | Casberg |
| 4,880,547 | A | 11/1989 | Etani |
| 4,901,926 | A | 2/1990 | Klotzbach |
| 4,933,178 | A | 6/1990 | Capelli |
| 4,935,135 | A | 6/1990 | Schaier |
| 4,971,687 | A | 11/1990 | Anderson |
| 4,979,245 | A | 12/1990 | Gandini |
| 5,006,267 | A | 4/1991 | Vaughn et al. |
| 5,011,600 | A | 4/1991 | Mowka et al. |
| 5,029,594 | A | 7/1991 | Pierce, Jr. |
| 5,066,408 | A | 11/1991 | Powell |
| 5,076,315 | A | 12/1991 | King |
| 5,122,274 | A | 6/1992 | Heskett |
| 5,149,354 | A | 9/1992 | Delaney |
| 5,167,049 | A | 12/1992 | Burkitt, III |
| 5,198,118 | A | 3/1993 | Heskett |
| 5,202,020 | A | 4/1993 | Desjoyaux et al. |
| 5,204,004 | A | 4/1993 | Johnston et al. |
| 5,236,581 | A | 8/1993 | Perry |
| 5,238,585 | A | 8/1993 | Reed, Sr. |
| 5,252,211 | A | 10/1993 | Searfoss, Jr. |
| 5,277,802 | A | 1/1994 | Goodwin |
| 5,314,623 | A | 5/1994 | Heskett |
| 5,328,602 | A | 7/1994 | Brooks |
| 5,332,511 | A | 7/1994 | Gay et al. |
| 5,347,664 | A | 9/1994 | Hamza et al. |
| 5,352,369 | A | 10/1994 | Heinig, Jr. |
| 5,372,714 | A | 12/1994 | Logue, Jr. |
| 5,383,239 | A | 1/1995 | Mathis et al. |
| 5,392,472 | A | 2/1995 | Maxfield |
| 5,405,614 | A | 4/1995 | Ohsuml et al. |
| 5,405,644 | A | 4/1995 | Ohsumi et al. |
| 5,409,608 | A | 4/1995 | Yoshida et al. |
| 5,441,529 | A | 8/1995 | Dorsch |
| 5,441,711 | A | 8/1995 | Drewery |
| 5,507,948 | A | 4/1996 | Wargo et al. |
| 5,525,215 | A | 6/1996 | Marchionda |
| 5,536,393 | A | 7/1996 | Weeks |
| 5,575,925 | A | 11/1996 | Logue, Jr. |
| 5,656,159 | A | 8/1997 | Spencer et al. |
| 5,681,988 | A | 10/1997 | Koch et al. |
| 5,743,287 | A | 4/1998 | Rauchwerger |
| 5,755,962 | A | 5/1998 | Gershenson et al. |
| 5,762,797 | A | 6/1998 | Patrick et al. |
| 5,779,913 | A | 7/1998 | Denkewicz, Jr. et al. |
| 5,785,845 | A | 7/1998 | Colaiano |
| 5,810,043 | A | 9/1998 | Grenier |
| 5,810,999 | A | 9/1998 | Bachand et al. |
| 5,820,762 | A | 10/1998 | Bamer et al. |
| 5,824,218 | A | 10/1998 | Gasser et al. |
| 5,824,243 | A | 10/1998 | Contreras |
| 5,853,581 | A | 12/1998 | Rayborn et al. |
| 5,857,594 | A | 1/1999 | Ozturk |
| 5,862,545 | A | 1/1999 | Mathis et al. |
| 5,868,933 | A | 2/1999 | Patrick et al. |
| 5,888,384 | A | 3/1999 | Wiederhold et al. |
| 5,888,386 | A | 3/1999 | Enright et al. |
| 5,888,392 | A | 3/1999 | Frizell |
| 5,919,554 | A | 7/1999 | Watterson, III et al. |
| 5,928,510 | A | 7/1999 | Meredith |
| 5,932,093 | A | 8/1999 | Chulick |
| 5,935,518 | A | 8/1999 | Richard et al. |
| 5,954,952 | A | 9/1999 | Strawser, Sr. |
| 5,980,740 | A | 11/1999 | Harms et al. |
| 5,980,761 | A | 11/1999 | Boissie et al. |
| 6,132,603 | A | 1/2000 | Briechle |
| 6,019,893 | A | 2/2000 | Denkewicz, Jr. et al. |
| 6,030,632 | A | 2/2000 | Sawan et al. |
| 6,038,712 | A | 3/2000 | Chalberg et al. |
| 6,065,161 | A | 5/2000 | Mateina et al. |
| 6,066,253 | A | 5/2000 | Idland et al. |
| 6,086,758 | A | 7/2000 | Schilling et al. |
| 6,122,775 | A | 9/2000 | Jacuzzi et al. |
| 6,138,703 | A | 10/2000 | Ferguson et al. |
| 6,153,095 | A | 11/2000 | Francisco |
| 6,162,401 | A | 12/2000 | Callaghan |
| 6,165,358 | A | 12/2000 | Denkewicz, Jr. et al. |
| 6,170,095 | B1 | 1/2001 | Zars |
| 6,171,496 | B1 | 1/2001 | Patil |
| 6,182,681 | B1 | 2/2001 | Robertson et al. |
| 6,190,547 | B1 | 2/2001 | King et al. |
| 6,199,224 | B1 | 3/2001 | Versland |
| 6,214,217 | B1 | 4/2001 | Sliger, Jr. |
| 6,238,575 | B1 | 5/2001 | Patil |
| 6,269,493 | B2 | 8/2001 | Sorensen |
| 6,270,662 | B1 | 8/2001 | Gibson et al. |
| 6,274,036 | B1 | 8/2001 | Ellis |
| 6,279,177 | B1 | 8/2001 | Gloodt |

| | | | |
|---|---|---|---|
| 6,280,617 | B1 | 8/2001 | Brandreth, III |
| 6,282,370 | B1 | 8/2001 | Cline et al. |
| 6,283,308 | B1 | 9/2001 | Patil et al. |
| 6,287,466 | B1 | 9/2001 | Yassin |
| 6,289,530 | B1 | 9/2001 | Miller et al. |
| 6,294,095 | B1 | 9/2001 | Lewis |
| 6,298,871 | B1 | 10/2001 | Pickens et al. |
| 6,308,350 | B1 | 10/2001 | Marchionda |
| 6,317,903 | B1 | 11/2001 | Brunelle et al. |
| 6,328,900 | B1 | 12/2001 | King |
| 6,331,432 | B1 | 12/2001 | Bautista et al. |
| 6,340,341 | B1 | 1/2002 | Purcell |
| 6,340,431 | B2 | 1/2002 | Khan |
| 6,342,841 | B1 | 1/2002 | Stingl |
| 6,357,060 | B2 | 3/2002 | Gloodt |
| 6,358,405 | B1 | 3/2002 | Leahy |
| 6,358,425 | B1 | 3/2002 | King |
| 6,390,340 | B1 | 5/2002 | Lynch, Sr. |
| 6,391,167 | B1 | 5/2002 | Grannersberger |
| 6,395,167 | B1 | 5/2002 | Mattson, Jr. et al. |
| 6,405,387 | B1 | 6/2002 | Barnes |
| 6,409,864 | B1 | 6/2002 | Choi |
| 6,419,839 | B1 | 7/2002 | Cox et al. |
| 6,419,840 | B1 | 7/2002 | Meincke |
| 6,444,129 | B1 | 9/2002 | Collins |
| 6,460,894 | B1 | 10/2002 | Weh et al. |
| 6,471,856 | B1 | 10/2002 | Keith |
| 6,497,822 | B2 | 12/2002 | Blanchette et al. |
| 6,500,332 | B2 | 12/2002 | Martin et al. |
| 6,511,605 | B2 | 1/2003 | Connelly, Jr. |
| 6,517,727 | B2 | 2/2003 | Pickens et al. |
| 6,523,192 | B1 | 2/2003 | Gloodt |
| 6,540,916 | B2 | 4/2003 | Patil |
| 6,544,415 | B2 | 4/2003 | King |
| 6,558,538 | B2 | 5/2003 | Scuilla et al. |
| 6,562,242 | B2 | 5/2003 | King et al. |
| 6,592,341 | B1 | 7/2003 | Olney |
| 6,592,766 | B2 | 7/2003 | King |
| 6,594,400 | B1 | 7/2003 | Kim |
| 6,623,634 | B1 | 9/2003 | Whitehurst |
| 6,630,106 | B1 | 10/2003 | Levy |
| 6,641,787 | B1 | 11/2003 | Siggins et al. |
| 6,651,825 | B2 | 11/2003 | Turner, Jr. et al. |
| 6,666,974 | B2 | 12/2003 | Page |
| 6,676,842 | B2 | 1/2004 | Scuilla et al. |
| 6,688,490 | B2 | 2/2004 | Carlson |
| 6,722,384 | B2 | 4/2004 | Gates |
| 6,749,746 | B2 | 6/2004 | Mokrzycki |
| 6,760,931 | B1 | 7/2004 | Mattson et al. |
| 6,792,925 | B2 | 9/2004 | Dworatzek et al. |
| 6,797,028 | B2 | 9/2004 | Duffy |
| 2003/0113378 | A | 2/2000 | Laridon et al. |
| 2001/0003217 | A1 | 6/2001 | Sorensen |
| 2001/0013373 | A1 | 8/2001 | Wright |
| 2001/0027573 | A1 | 10/2001 | Gloodt |
| 2002/0113025 | A1 | 8/2002 | Gauldin et al. |
| 2002/0117432 | A1 | 8/2002 | Lincke |
| 2003/0029289 | A1 | 2/2003 | Patil |
| 2003/0029789 | A1 | 2/2003 | Patil |
| 2003/0150796 | A1 | 8/2003 | Heinig, Jr. |
| 2003/0178374 | A1 | 9/2003 | Arsta |
| 2003/0213059 | A1 | 11/2003 | Mattson, Jr. et al. |
| 2004/0025249 | A1 | 2/2004 | Desmond |
| 2004/0168249 | A1 | 9/2004 | Mattson et al. |
| 2004/0168962 | A1 | 9/2004 | Mattson et al. |
| 2004/0188346 | A1 | 9/2004 | Clive et al. |

FOREIGN PATENT DOCUMENTS

| | | |
|---|---|---|
| DE | 19961049 | 6/2001 |
| JP | 04-214150 | 8/1992 |
| JP | 4-214150 | 8/1992 |
| JP | 07-080218 | 3/1995 |
| JP | 7-80218 | 3/1995 |
| JP | 10-192847 | 7/1998 |
| JP | 11-267414 | 10/1999 |
| JP | 11-267614 | 10/1999 |

OTHER PUBLICATIONS

Lasco Bathware, Inc. Acrylic Builder's Choice Whirlpools Alydar I & II, Information Page (2 pages).
American Standard Bathroom Fixtures and Faucets, Product Details, Internet Web Page at www.americanstandard-us.com., Apr. 14, 2004, 2 pages.
Frequently Asked Questions-Sani Jet Website-William J. Costerton PhD. Microbioligist.
Bio Films a Growing Problem William J. Costerton PhD Microbioligist.
Decorative Plumbing Sep. 12, 2000 F.A.Q #4 Air Tub.
Dr. Christine Pasko-Kolva P.h.D Enviromental Group Leader, SaniJetWebsite.
Hyrotheaphy Tub Usage by: Scott Budgell and Bernice Thompson.
Merram-Webster Online Dictionary Whirlpool Bath.
Rita Moyes, PhD Director of the Microbiology Labratory Texas A&M.University—SaniJetWebsite.
What is Ozone U.S. Enviromental Protection Agency.
Canadian Infection Control Guidelines for Long-Term Facilities, Rev. 1993 (pp 8-9).
Class Action Reporter Nov. 19, 2001, vol. 3, No. 226.
Relaxing in Filth: What Your Hottub May Be Hiding By: Kelli M. Donley.
Ozone Generators That are Sold as Air Cleaners: An Assessment of.
Effectiveness and Health Consequences http://www.epa.gov/laq/pobs/ozonegen.
html #how % 20 is % 20 harmful, visited Jan. 16, 2005 EPA Website 9 pages.
Lasco Cleaning—Circulation System p. 19 and 24.
U.S. Appl. No. 10/459,665, Craig Selover.

2
36B
32A
39C
39B
39A
36A
63
62
61
40

2
36A
37B
37A
37
32B
32A
85

36B
37A
37B
2
36A
37
38

ANTIMICROBIAL WHIRLPOOL BATHTUB

REFERENCE TO RELATED APPLICATION

This non-provisional patent application is a continuation of U.S. patent application Ser. No. 10/841,925 entitled Low Water Retention Antimicrobial Whirlpool bathtub filed May 7, 2004, which is a divisional of U.S. patent application Ser. No. 10/211,497 entitled Non-Electrical Sanitation Water Vessel System, filed Aug. 2, 2002, which is now U.S. Pat. No. 6,760,931.

FIELD OF THE INVENTION

The present invention relates to a method of making an antimicrobial whirlpool bathtub.

BACKGROUND OF THE INVENTION

Whirlpool-type baths have been employed to treat discomfort resulting from strained muscles, joint ailments and the like. More recently, such baths have been used increasingly as means of relaxing from the daily stresses of modern life. A therapeutic effect is derived from bubbling water and swirling jet streams that create an invigorating hydro massage of the user's body.

To create the desired whirlpool motion and hydro massage effect, a motorized water pump draws water through a suction fitting in a receptacle, such as a bathtub. The user first fills the bathtub. Then the user activates the closed loop whirlpool system. The water travels through a piping system and back out jet fittings. Jet fittings are typically employed to inject water at a high velocity into a bathtub. Usually the jet fittings are adapted to aspirate air so that the water discharged into the receptacle is aerated to achieve the desired bubbling effect. (See for instance, U.S. Pat. No. 4,340,039 to Hibbard et al., incorporated herein by reference from U.S. Pat. No. 6,395,167 to Mattson, Jr. et al. ("Mattson") which is incorporated herein by reference.

Generally, whirlpool baths are designed as with a normal bathtub to be drained after each use. However, debris in the form of dead skin, soap, hair and other foreign material circulates throughout the piping and pump system. This debris does not completely drain and over time, accumulates in the piping system and may cause a health risk. Therefore, a filtration system designed for whirlpool baths was desirable. Mattson provides for a filtration system, which filters debris in the water with respect to whirlpool baths. The present invention improves upon the Mattson filtration system for whirlpool baths. Before Mattson, filtration systems were found only in indoor and outdoor pools.

For some time, whirlpool bath manufacturers have tried to devise a way to incorporate a filtration system on a closed loop whirlpool bath. Although many problems exist, compliance with the plumbing codes is the major obstacle faced in using a filtration system for a whirlpool bath. Until Mattson, there was no filtration system that specifically designed for a drain down whirlpool bath that allows a whirlpool bath to pass requirements set forth by the current plumbing code.

Whirlpool baths must meet stringent drain down code requirements set up by the American Society of Mechanical Engineers (ASME). The code that governs whirlpool baths is entitled "Whirlpool Bath Appliances" (ASME A112.19.7M 1995). Section 5 of this code covers water retention and provides: "whirlpool bath appliances shall be of such design as to prevent retention of water in excess of 44 ml. (1½ fl oz) for each jet and suction filter."

The average whirlpool bath has a six-jet system and has one suction fitting. In order to meet code, a six-jet/one suction system configuration may only retain 10½ ounces of water in the complete whirlpool bath system after draining. Most quality whirlpool baths, however, retain less than 4 ounces of water in the whirlpool bath system after draining. The filter part of the system cannot retain over 6½ ounces of water, because the total water retention would then exceed 10½ ounces. Mattson is currently the only known filtration system designed for whirlpool baths that retains less than 6½ ounces of water. The complete filtration system of the present invention, however, retains less than 4 ounces of water and as little as 2 ounces of water; so most whirlpool bath companies could use it on their whirlpool bath models and pass the drain down codes for whirlpool baths.

Another important consideration in developing a filtration system for whirlpool baths is the ease of replacing the filter. To eliminate access panels on the underside of the whirlpool bath which are used to access the filter, the filtration system was designed so the filter could be replaced from inside the bath. Therefore, the most logical choice for a filter location is in the suction fitting. However, placing the filter in the suction fitting presents a different range of design concerns. For example, placing a filter in the suction fitting may cause undue stress on the pump motor.

The suction filter must pass the codes set up by ASME for suctions which include a variety of load and structural tests. The code for suctions from ASME is titled Suction Fittings For Use in Swimming Pools, Spas, Hot Tubs, and Whirlpool Bathtub Appliances (ASME/IAMPO reaffirm 1996). Presently there is only one patented whirlpool bathtub suction filter that passes ASME code to be placed on a whirlpool bathtub. See Mattson incorporated herein. The present invention provides a cavity that houses a filter that could be installed in such a way that the filter is replaced from the inside of a whirlpool bath.

The filter was designed to be small to meet the drain down requirements. Because of its small size, however, it also had to be very efficient. Therefore, the present invention has a specially designed filter core. The core is engineered with varying spaced and sized holes along the length of the core. This design allows water to be drawn through the entire filter. Without this design, the filter would only pull water through about 20% of the filter near the outlet.

Other problems in whirlpool bathtub and spa use are encountered when a user's hair is twisted and entrapped in the whirlpool bath pump impeller. Hair entrapment occurs when a bather's hair becomes entangled in a suction fitting drain cover as the water and hair are drawn powerfully through the drain. The Consumer Product Safety Commission has issued a safety alert article entitled "Children Drown and More Are Injured From Hair Entrapment In Drain Covers For Spas, Hot Tubs, And Whirlpool Bathtubs" (CPSC Document #5067). The safety alert urges consumers to ask their spa, hot tub, and whirlpool bathtub dealers for drain covers that meet voluntary standard ASME/ANSI A112.19.8M 1987) to help reduce hair entrapment. The present invention meets the voluntary ASME/ANSI standard.

The present invention also provides a new faceplate cover which is easily removable. The faceplate also has to pass the heavy load, impact and hair entrapment tests set out by ASME/IAMPO. One cover embodiment has a radius and back ribbing on it and a removable insert support to pass the strength tests. An embodiment of the faceplate is flat with structural fins on its back side, thus eliminating the removable insert. Each cover has a sufficient number of sized holes to pass the prescribed hair entrapment tests. The result is the fluid suction filter device that is especially made just for whirlpool baths.

In the safety alert CPSC Document #5067, the Consumer Product Safety Commission suggests that consumers shut down the spa until the drain cover is replaced in the event that the consumer discovers the drain cover missing or broken. The present invention allows the water system to shut itself down if the faceplate drain cover is missing or broken by means of a non-electric cavitation mechanism. The water system is also shut down if a clog occurs.

It is found that even after debris is filtered from a whirlpool bathtub, trace amounts of bacteria still can grow in a whirlpool bathtub. In fact, even if normal tap water where to be run through the closed looped system of a whirlpool bathtub, trace amounts of bacteria can form in the whirlpool bathtubs closed looped piping system. To eliminate these trace bacteria, a special filter core with an antimicrobial chamber was developed.

This antimicrobial chamber emits antimicrobial agents to kill the trace bacteria that may grow in the whirlpool bathtub's closed looped piping system, upon initial whirlpool bathtub activation and between usages. However, most of the antimicrobial agents would dissipate as soon as they enter the inside of the bathtub where people bathe. In other words, due to breakdown and dissipation, the antimicrobial agents do not build up in the bath water as the whirlpool operates. Therefore, the user may activate the antimicrobial dispenser mechanism to distribute antimicrobial agents at will or on a timed basis. The antimicrobial dispenser is a top filled design not known in the prior art. Another embodiment teaches the use of multiple chambers wherein each chamber is used for additional additives desired by the user.

Only a very small amount of antimicrobial agent is necessary to kill the bacteria in the closed looped piping system since the filter helps to trap hair, soap and other debris, which provides food for bacterial growth. Without the filter a greater amount of antimicrobial agent would need to be introduced into the system to kill the bacteria and this excessive amount could irritate the skin of sensitive bathers.

Another integral part of creating a total water vessel sanitation system is to include antimicrobial additives in each component of the water vessel. With respect to whirlpool bathtubs and spas, this would include at least the system's water and air pipes, pump, and pump impellor. The surfaces of whirlpool bathtubs and spas are comprised primarily of a thermo-formed acrylic or plastic sheet or gelcoat paint. Therefore, in a total water sanitation system, the acrylic or plastic sheet or the gelcoat paint would require antimicrobial additives. The fiberglass and resin reinforcement backing of the whirlpool bathtub and spa are impregnated with antimicrobial additives, as are the whirlpool bathtub jets and suctions. While the technology exists to add antimicrobial additives to a whirlpool bathtub and spa component, there is no prior art that suggests that antimicrobial additives be placed in one or more component or in combination with all components to provide for optimum protection from bacteria.

U.S. Pat. No. 6,395,167 (2002) to Mattson, Jr. et al. discloses a whirlpool bath with combination suction fixture and disposable filter. The housing of the suction filter is one to two feet long. A correspondingly sized replaceable filter is mounted into the filter housing lengthwise.

U.S. Pat. No. 6,283,308 (2001) to Patil et al. discloses a bacteriostatic filter cartridge having elements impregnated with an anti-microbial agent.

U.S. Pat. No. 5,799,339 (1998) to Perry et al. discloses a suction device for a spa or jetted tub with a turbulence reduction design to reduce the possibility of entangling a user's hair in the faceplate.

SUMMARY OF THE INVENTION

The main aspect of the present invention is to provide a method to make an antimicrobial whirlpool bathtub.

Other aspects of this invention will appear from the following description and appended claims, reference being made to the accompanying drawings forming a part of this specification wherein like reference characters designate corresponding parts in the several views.

The suction filter is comprised of the filter core, the filter, and the filter housing. The filter core has a plurality of water draw holes having increasing diameters extending away from the water outlet. These holes provide for water draw along the entire length of the filter, instead of just making use of the filter at the outlet and of the filter. These increasing and decreasing holes provide for optimum water draw through the filter that surrounds the core. The filter core has a 2" inside diameter (I.D.) to assure over 200 GPM water flow draw rates. Without this I.D., you would not be able to get 200 GPM to run through the filter core allowing a combination filter suction an overall 200 GPM rating. No other manufacturer makes a filter for whirlpool bathtubs or even a filter that fits into a housing outlet with a 2" I.D. The core is made from injected plastic but could be machined from metal or a variety of other materials.

The filter core has an antimicrobial chamber that houses antimicrobial additives. The antimicrobial chamber measures approximately 1" to 8" in length and ½ to 2" in diameter. The antimicrobial additives used in the antimicrobial chamber could be slow dissolving chlorine, bromine, or a variety of other antimicrobial additives. The cover to the antimicrobial chamber has an adjusting hole opening which can be increased or decreased by turning the main body of the antimicrobial chamber in one direction or another. The more the antimicrobial chamber is screwed on, the smaller the hole opening becomes. The antimicrobial chamber has one hole but could have multiple holes or slots. The filter core's plastic is injected with antimicrobial additives during the injected molding process and inhibits any germ growth on the core between uses.

Multiple chambers may be added on the filter core along with the antimicrobial chamber for the addition of other additives. For example, the filter core may have a built in ion exchange chamber allowing for a built in water softener that softens the bathwater. It may also have a fragrance chamber that emits fragrances into the bathwater. Both of these items are not known in prior art for a suction filter core for a whirlpool bathtub or spa.

Water flows past the antimicrobial chamber creating a vacuum which pulls a small quantity of antimicrobial additive from the chamber, thereby mixing it with the water. The amount of antimicrobial additives mixed into the water is in sufficient quantities to kill the trace bacteria that may grow between whirlpool bath usages in a filtered whirlpool bathtub system. The antimicrobial additives dissipate by the time the antimicrobial additives mix and enter the larger volume of water in the bathing area.

A filter which is generally treated with antimicrobial additives either slips over the filter core or is bonded onto the core making a one-piece filter core combination. Although the filter could be pleated or non-pleated, an embodiment has a two staged pleat filter media. The first pleat has larger holes, which allow larger sized particles and debris to pass through the antimicrobial treated filter pleat. The second pleat has smaller openings allowing only microscopic debris particles to pass through the treated filter pleat. Although microscopic debris may accumulate in the space between the inner and outer pleats, both filter media are impregnated with antimicrobial agents, which kill bacteria which would accumulate on the pleats. Together, the inner and outer pleat create a halo effect killing of the bacteria which accumulates between the inner and outer filter media. This layered filter design is important in decreasing the build up of debris on the outer layer of the filter which nearest to the bather.

The filter media is preferably made out of polypropylene or other media that will accept antimicrobial agents. In the spa industry, polyester media is used. Polypropylene media can be treated in the manufacturing process with antibacterial agents, whereas polyester media cannot. In the whirlpool industry, however, filters were not used on whirlpool baths until an approved filtration system for whirlpool baths under the Mattson '167 patent.

One embodiment of the filter is designed to retain less than 3 ounces of water.

The housing of the suction filter is generally cylindrical having a diameter of four inches to two feet. The filter housing is tapered from front to back to allow water to drain back into the tub after shutdown. An embodiment of the housing is the only known housing that has tapered sides of the inner wall to allow water to drain back into the whirlpool bathtub when the whirlpool bathtub system is deactivated whether the unit is installed facing left or right. The filter housing has a sharp radius end opposite the outlet end, thus allowing the housing to be fitted into the side wall of a tub through a standard size opening cut.

The filter housing is mounted to the inner tub wall by using a screw nut between the housing mounting flange and the inner tub wall. A gasket or silicone can be used between the outer tub wall and the screw nut to prevent leaks.

The filter core now fits into the filter housing in axial alignment with the filter housing's inlet opening. In other words, the filter is now perpendicular from that of U.S. Pat. No. 6,395,167. The filter core has two slots cut into the end that fits into the outlet of the filter housing. The filter housing has two male ridges which make the filter core the only filter core that fits that particular housing. As set forth above, the filter core is designed with varying sized holes and slots. The holes furthest from the outlet port are larger than the holes near the outlet port. This allows water to pull through the entire filter.

The filter housing has a safety cavitation port located at the inside wall of the housing. Placing a cavitation port at the inside wall of a suction fitting is not known in prior art.

The faceplate cover described below has a cavitation port fin, which covers the non-electric cavitation port when the faceplate cover is attached to the filter housing. The cavitation port fin is one of four available cavitation port fins designed to fit into a receiving bracket adjacent to the cavitation porthole. If the filter were removed or if a person tried to operate the unit without the filter core covering this hole, air from the tube would be drawn into the pump and the pump would cavitate (draw more air than water). Since people have drowned by getting their hair caught in a suction cover while their head is below the tub waterline, this is an important feature. No user could run the unit without the filter in place. This feature also reduces the chance of drawing contaminants into the whirlpool bath system. Once contaminants such as hair are entrapped in the pump's impeller, the entire whirlpool bath system becomes contaminated until someone physically opens the whirlpool bath pump (a long and time consuming process usually requiring a professional), frees the entrapped hair, and sanitizes the complete system.

The filter core has a gasket that slides over the non-electric safety cavitation port. Without this gasket, the replaceable filter core could rub against the filter housing outlet and cause wear over the years to the filter housing outlet.

The suction filter has been downsized to fit more whirlpool bathtubs. The downsized version attaches to the whirlpool bathtub with a nut which eliminates the attachment screws of U.S. Pat. No. 6,395,167. With the smaller filter design, however, filter replacement is likely to occur more often.

The present invention has two lights that are placed in a visible position on the whirlpool bathtub. The lights are hooked up to the whirlpool bathtub pump with a vacuum switch. If the combination suction filter, filter media (removable filter) accumulates enough debris, this blockage on the filter triggers a vacuum switch, which senses the blockage, and a preferably red indicator light comes on that indicates to the bather that it is time to remove and clean the removable filter or simply replace it. Otherwise a preferably green indicator light stays on indicating to the bather that the filter is not ready for replacement.

The present invention also provides another means to indicate when to replace the filter. The end cap of the filter is treated with a special chemical in the manufacturing process, which creates a color reaction when the end cap is introduced to water. The first color would indicate the filter is not ready for replacement. The second color would indicate the filter should be replaced. For example, the end cap is white before water submersion. Once water is introduced to it, the reaction begins and the end cap will slowly turn to black over a predetermined period of time. During whirlpool bathtub operation but before the predetermined period of filter life time, the end cap color will range from white to varying shades of grey until it becomes totally black. Once it turns totally black, the bather knows it is time to replace the filter. This reaction may be have a time release factor and can last from 1 to 360 days depending upon the amount of chemicals used in the end cap manufacturing.

Another inlet orifice may be added to the filter housing of the present invention. This orifice can be hooked up in tandem to a skimmer filter in a spa in order to filter water, which may bypass a filtration system. Currently spas, like whirlpool bathtubs, have one or multiple suction fittings that draw water into a pump and back out through jets. Although spas also have skimmers filters that draw surface water through the filters into a pump and back through the jets, the majority of the water passing through other suction points bypasses the filters in the skimmer causing contaminated water to circulate through the system. Most of the other suction points do not have filters. By replacing standard spa suction fittings with the present invention suction filter and hooking the outlet of the spa skimmer to one of the present invention suction filters, all water in a spa is filtered.

The faceplate shown in FIGS. 4A through 4D slides into the housing to cover the suction filter assembly. The faceplate has a radius shape to prevent a limb from being sucked up against it, which could entrap a body part. ASME hair entrapment standards are met using a plurality of slots or holes. Impact and load tests are met.

In the embodiment of the faceplate shown in FIGS. 4B, 4C, support ribs (also known as support bars) are built into the faceplate and fit into receiving slots in the faceplate housing. This creates a solid part and allows it to pass impact and load tests called out by ASME code. This is the only suction faceplate for whirlpool bathtubs and spas that is designed with the structured supports in the faceplate. This allows a filter to be installed in the suction housing or replaced and still pass these test. All other known suctions have the main structured support as part of the body (housing) and these supports cannot be removed. See U.S. Pat. No. 5,799,339 to Perry et al. which represents all other known suctions. FIG. 5 of U.S. Pat. No. 5,799,339 shows a face view of the support. FIG. 3 shows how FIG. 5 screws in permanently into body 20 of FIG. 3. These supports (26*b*, 28*b* called a guide) cannot be removed once the suction is installed.

The faceplate is larger than standard faceplates because of the size of the removable filter. Mattson teaches the combination of a filter and a suction in a single device. The faceplate has slots to allow a larger volume of water to pass through it. Because of the increased size of the faceplate the slots have to be designed and engineered in a radiating pattern. This is very important for the plastic injected molding process.

With the present design over a horizontal (see Perry '339 patent) or vertical design, the pressure of the injected plastic from the injection point of the mold (usually the injection point of a mold is located in the center of the mold) hits the small end of the slots instead of the wide end of the slots. The shorter end of the slot can withstand a great deal more pressure over time before failure than if the pressure were subjected to the wide side of the slots. This allows for much longer mold life and a more pleasing finished product. The radiating pattern of slots gives a straight-line flow to the outer edge of the faceplate part. U.S. Pat. No. 5,799,339 FIG. 4 shows a standard slot opening arrangement that represents the arrangement of slots used by manufacturers of slotted face faceplates. U.S. Pat. No. 6,038,712 to Chalberg et al. FIG. 2 shows circular hole openings which represent how other faceplates are made. Slots are preferable over circular holes to increase flow.

One embodiment of the faceplate housing eliminates the drain down slots of the original design because water now evacuates through the bottom slots of the faceplate.

To prevent people's hair or body parts from getting trapped in the exposed hole where the faceplate cover is removed during whirlpool bath operation, current ASME plumbing code requires that all suction faceplate covers be engineered so the faceplate cannot be removed without the use of a tool. Most suction covers attach the faceplate to the housing with a screw and a screwdriver is needed to remove the screw. See U.S. Pat. No. 6,038,712 FIG. 2, which shows screw hole openings and U.S. Pat. No. 5,799,339 FIG. 3 number 22, which shows the screw. There are some suction manufacturers that have a non-electric cavitation device in the faceplate of the suction, see Chalberg U.S. Pat. No. 6,038,712. If the face of the suction is restricted significantly, the unit cavitates and the suction against the faceplate decreases. However, these designs are still dangerous. Hair can still become twisted in the faceplate before the unit shuts down. It is thought that if hair enters the Chalberg '712 cover and the cover is blocked to cease suction action, the hair can be easily removed. However, when hair enters a suction cover a vortex may form behind the cover causing the hair to twist and tangle, thereby preventing removal. Once the hair is trapped, you need a tool like a screwdriver by code to take the faceplate off. The entrapped hair can trap the head of the user under the tub's waterline. Therefore, people still can drown with these devices.

As stated above, the code requirement for a tool to remove the faceplate is to prevent body parts or hair from getting trapped in the exposed housing support cross members (which are an integral nonremovable part of the suction body in the event that the faceplate of current suctions is removed. But because one embodiment of the suction filter will not operate without the filter in place, there is no need for the screw. The faceplate preferably attaches to the faceplate housing with magnets. The magnet hole openings of the housing are recessed for flush mounting. They also are flat recessed.

With the design of the present invention, there is no danger of limb entrapment because the system would simply not operate. If someone did get his or her hair caught in the faceplate while the filter was in place, the whole faceplate pops off easily as the faceplate is held in place by magnets. As soon as the faceplate pops off, the cavitation fin which normally covers the safety cavitation port would move out of place. Once the non-electric cavitation port is uncovered, the pump cavitates, thereby immediately preventing body limbs or hair from becoming entrapped in the exposed suction opening. The suction cover has a pull-tab on the cover to allow the bather to easily remove the cover when the whirlpool bath pump is in operation if desired. Depending on the alignment of the faceplate with the faceplate housing, the pull tab could be at any of four locations, i.e., bottom, top, left, or right.

If the unit were to run without the faceplate cover, and hair is caught in the exposed filter, the filter itself also pops out easily. Therefore, there is no chance of getting entrapped if the filter is removed, because the unit will also cavitate under these circumstances.

With the present invention, we plan to have ASME revise their codes for suction covers to allow them to be removable without a tool such as a screwdriver.

U.S. patent application Ser. No. 09/417,156 SORENSEN, EDWIN C. shows a break away drain cover for a spa. Sorensen operates a magnetically actuated switch transmitting an electrical signal. It does not have a safe non-electrical safety cavitation port like the present invention. People are concerned when any electrical signal is transmitted in a water vessel. U.S. patent application Ser. No. 2001/0013373 WRIGHT, JAMES R. shows a drain cover which is similar to the drain cover of Sorensen.

Both these inventions are drain covers and not suction fittings because they do not conform to ASME suction fitting codes. Neither pass the ASME code requirements set out in Section 4 for "Suction Fittings For Use in Swimming Pools, Spas, Hot Tubs, and Whirlpool Bathtub Appliances" (ASME/ANSI A112.19M-1987 reaffirm 1996) and Section 7 ASME A112.19.7M-1995, the hair entrapment test. Sorensen uses a "snap fit" to attach the faceplate to a drain wall fitting that may present a wear problem over the years as the cover is repeatedly put on and taken off. The present invention uses earth magnets that will last the lifetime of the spa or bath it is placed on.

Further, the Sorensen invention does not claim, when used in conjunction with a whirlpool bath instead of a spa, that it will allow the whirlpool bath to meet the drain down requirements of ASME A112.19.7M-1995, "Whirlpool Bathtub Appliances." The present invention does so claim. Another advantage of the present invention over Sorensen is that the non-electric cavitation safety feature (combination port hole, air tube, faceplate, cavitation fin) costs a fraction of what a signal-transmitting device would cost to manufacture. Therefore, while there is prior art for electronics-based breakaway covers in a variety of inventions, there is no prior art for a breakaway cover that utilizes a cost saving non-electrical cavitation port. Being non-electrical makes the present invention very safe for whirlpool bath, spa and swimming pool applications.

The faceplate back support ribbing is designed in an X pattern, which offers outstanding structural integrity. The circular ribbing adds tremendous strength to the center impact point of the faceplate.

The faceplate is designed to protrude less than ½" into the tub when attached to the faceplate housing. This streamlined design protrudes much less than most current suctions adding more room to the bathing area of the whirlpool bathtub.

The slotted holes on the top, sides and bottom of the faceplate extend outward keeping in line with the radiating design pattern on the face of the faceplate. This makes it an easier part to inject with plastic.

Because the center faceplate is an area that would have a high fluid intake flow, the center of the faceplate is solid. This solid center section evens out the water flow across the rest of the faceplate so that there are no areas of high flow that would create unwanted areas of high suction force.

Support bars (or ribs) are integrally formed on the backside of the faceplate. The support bars are at right angles to each other and extend between opposite sidewalls of the faceplate. The support bars do not obstruct any of the faceplate slots formed in the face and sidewalls of faceplate. This configuration advantageously prevents hair from entering a faceplate slot and becoming entangled by wrapping around both sides of a support bar.

The faceplate housing has a flange that provides a resting area for the peripheral ledge of the faceplate when the faceplate is attached to the housing. This resting area allows for weaker magnets to be used to keep the faceplate attached to the faceplate housing.

An important feature of the present invention suction filter is the use of an antimicrobial system that is air actuated by depressing a button located on the inside wall or rim of a whirlpool bathtub. When the button is depressed, antimicrobial additives are injected via a tube into the outlet opening of the suction filter. This allows the bather the opportunity to inject a larger amount of antimicrobial additives into the whirlpool bathtub prior to entering the bathtub to give an added safeguard that all bacteria is killed in a whirlpool bath that has not been in operation for an extended period of time. Depressing the button not only injects antimicrobial additives into the outlet of the housing, it disperses the additives. When the tub is filled with water, the injected additives travel first to the pump housing in a high concentration (the pump housing is found to be the place where bacteria growth is the highest) and then throughout the rest of the closed looped piping system, all the while killing bacteria. The greater the period between uses, the more likely a larger amount of bacteria can form in the whirlpool bathtub's piping system. This safeguard ensures that when activated, the whirlpool bathtub will be bacteria-free even if months have passed since the whirlpool bathtub system was operated.

The present suction filter device could be designed in other configurations than its current square-shaped form. The unit could also be designed in a round form or any other shape or size. The filter and filter core could also be made shorter, longer, larger or smaller. The filter could be made smaller for less money to be disposable after each whirlpool bath use. The filter could even be designed in such a way to be incorporated into existing suctions with modification of those suctions. The filter media that filters the water could be pleated or wrapped without pleating around a filter core.

The housing could be designed to incorporate multiple filters. The ridges and slots at the end of the filter core could be made in a variety of shapes or locations to ensure the use of only one filter.

The main body housing could be vacuum formed and become an integral part of the whirlpool bathtub.

The magnets holding the faceplate to the housing could be larger or smaller and arranged in various other locations on each part. The amount of magnets used could be increased or decreased. The faceplate could also be attached using various snap-on configurations. An installation-sealing gasket could be used. The slope in the sidewalls of the housing could be increased or decreased. The overall size of the suction filter could be increased or decreased.

The housing body, faceplate or filter core could be made from other material than injected plastic; it could be stamped or machined out of metal or other material.

The radiating slotted design of the faceplate could have a radiating round hole design.

The safety cavitation hole could be placed anywhere rearward on the outlet of the housing and be various sizes or have multiple openings.

The filter could have various sanitizing materials in its core such as slow dissolving chlorine tablets or other sanitizing material incorporated into the filter core.

The screw nut that attaches the housing to the sidewall of the whirlpool bathtub could have a washer or use locking nuts and have varying sizes and be made out of a variety of materials, including plastic and nylon or some space age material.

Before explaining the disclosed embodiment of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION OF DRAWINGS

Figure 1:
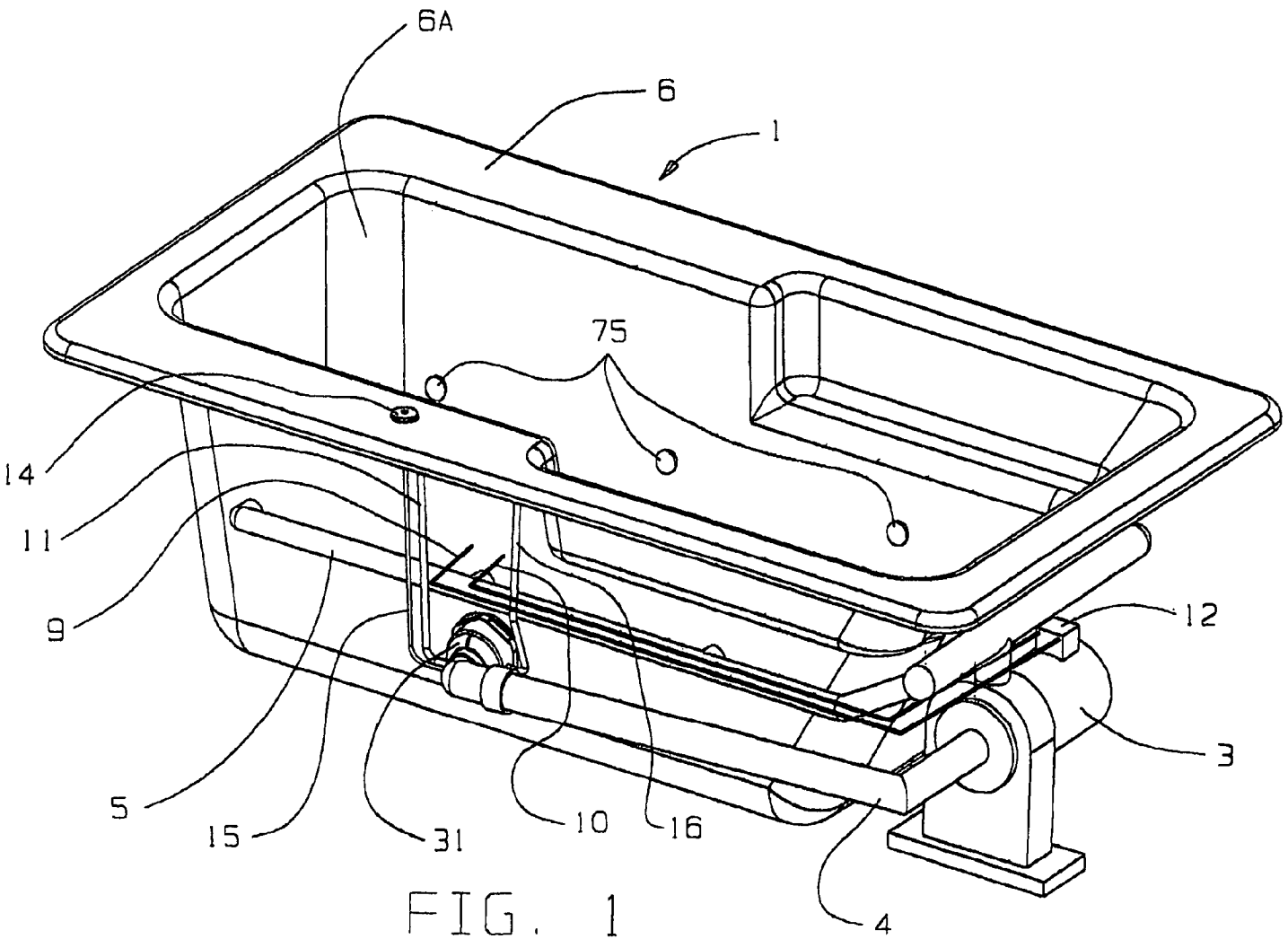
FIG. 1 is a top perspective view of a whirlpool bath having an alternate embodiment of the suction filter and antimicrobial system installed therein.
Figure 14:
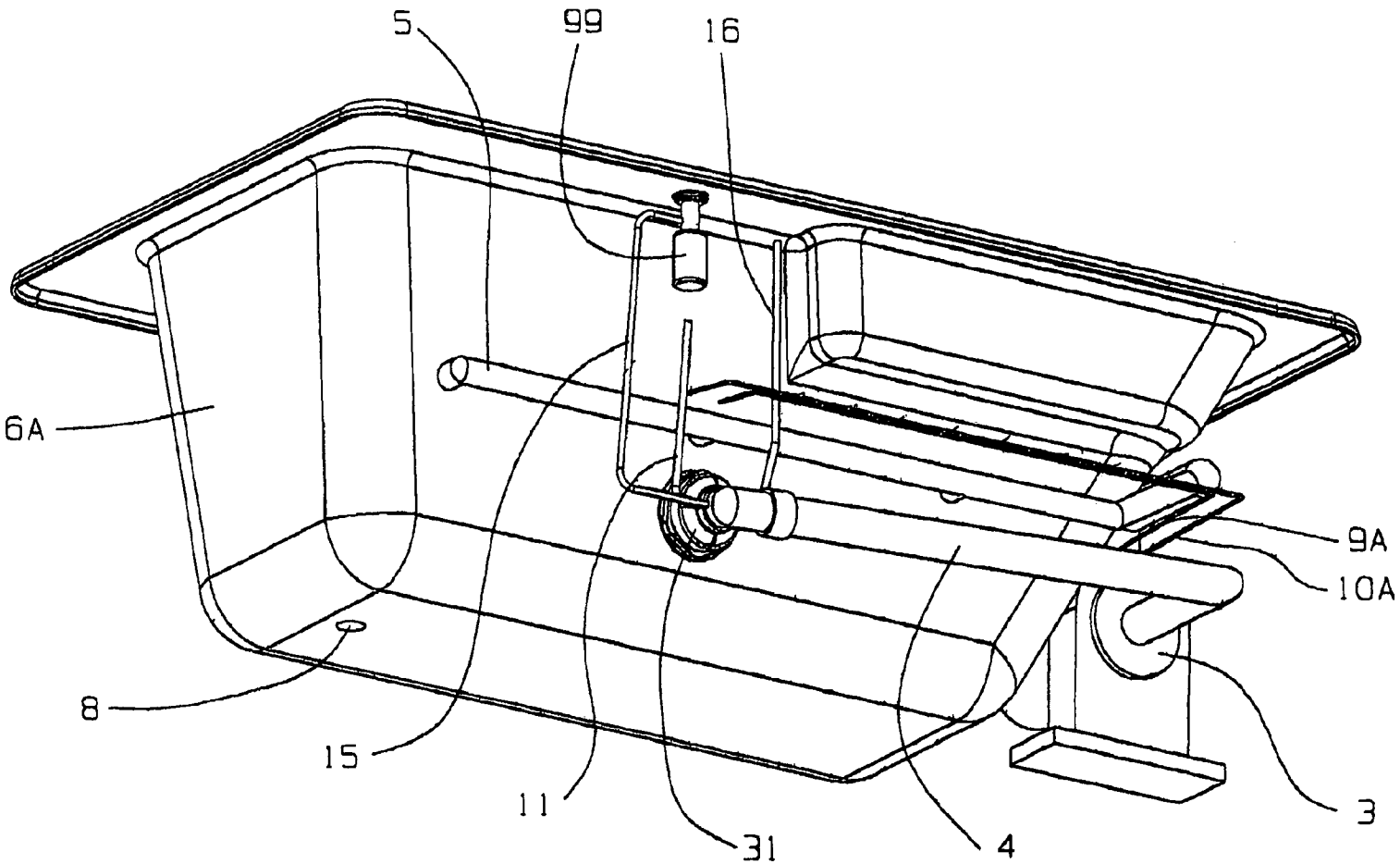
FIG. 14 is a bottom perspective view of a whirlpool bath of FIG. 1 showing an embodiment of the suction filter and antimicrobial dispenser installed therein.
Figure 15:
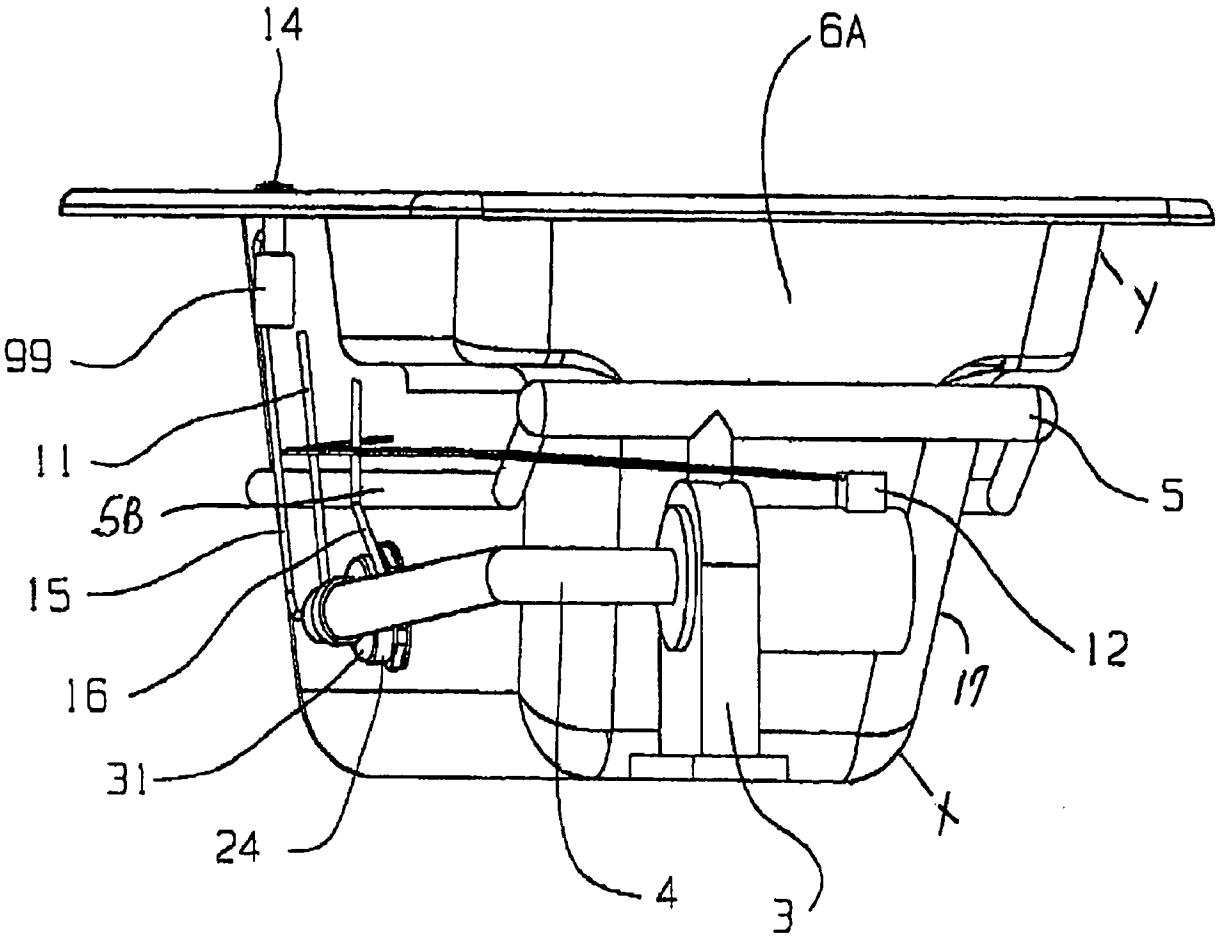
FIG. 15 is a plan view of the FIG. 1 whirlpool bath.

Referring first to FIGS. 1,14,15 a whirlpool bathtub water vessel 1 has a tub 6 with a standard tub wall 6A and a standard tub drain 8. During whirlpool use the pump 3 circulates water via outlet pipe 5, air mixing pipe (not shown) and jets 75. Water is drawn from the filled tub 6 via pump inlet pipe 4 which is connected to the suction filter 2, an alternate embodiment, mounted within the filter housing 31. A switch 12 activates the pump 3. Filter sensing cavitation line 11 and faceplate sensing cavitation line 16 extend from suction filter housing 31. Sidewall 17 is sloped from position y to position X.

When filter sensing line 11 detects a missing filter, the pump 3 cavitates. Likewise, when faceplate sensing line 16 detects a missing or broken faceplate, pump cavitation occurs.

Injector button 14 is depressed to activate the antimicrobial additives dispenser 99 (see FIG. 14), which dispenses antimicrobial additives to water vessel 1 via antimicrobial line 15. Electric power lines 9A, 10A for green and red indicator lights 9, 10 respectively, connect to switch 12.

Figure 7:
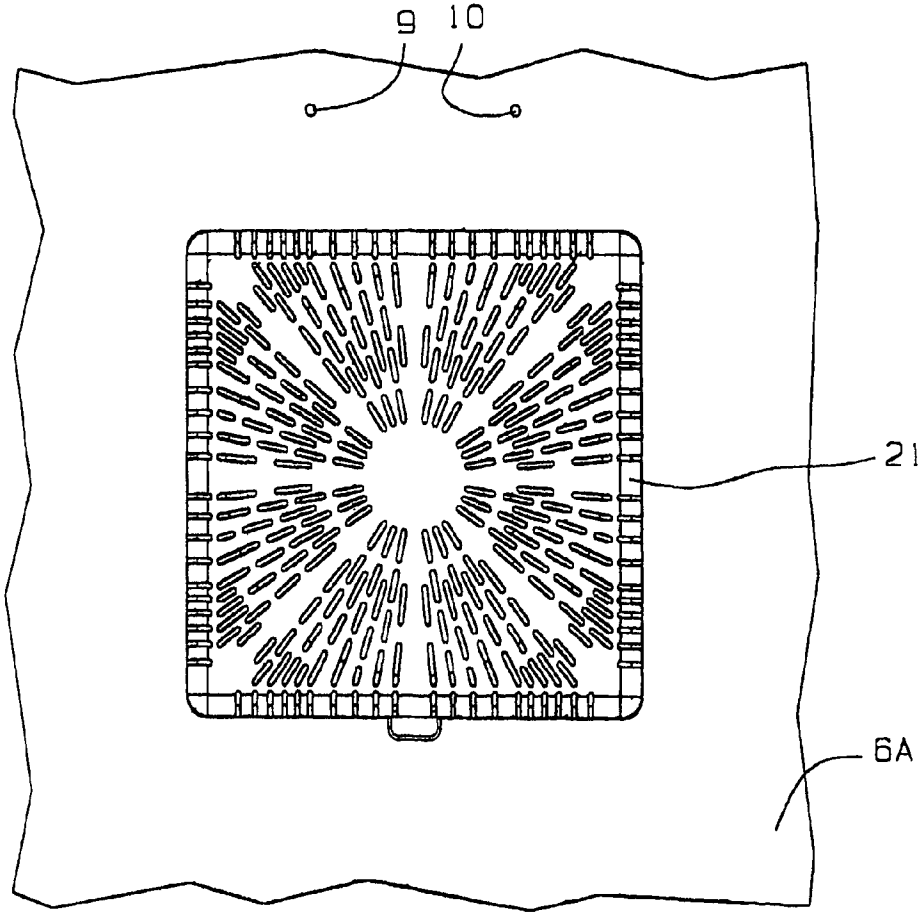
FIG. 7 is a plan view of the faceplate of the suction filter as viewed from the inside of the whirlpool bath shown in FIG. 1.

Referring next to FIG. 7, the suction filter 2 is shown as seen by a bather in the tub of FIG. 1. The only visible portion of the suction filter 2 is a the faceplate 21 attached to the inner tub wall 6A.

Two lights are shown placed near the inside wall 6A of the whirlpool bathtub near the suction filter 2. However, the lights may be placed anywhere on the tub wall. If the system detects a blockage of the filter 200 (see FIG. 8), a red indicator light 10 comes on that indicates to the bather that it is time to remove and clean the filter 200 or replace it. Otherwise, green indicator light 9 stays on indicating to the bather that filter 200 is not ready for replacement.

Figure 2:
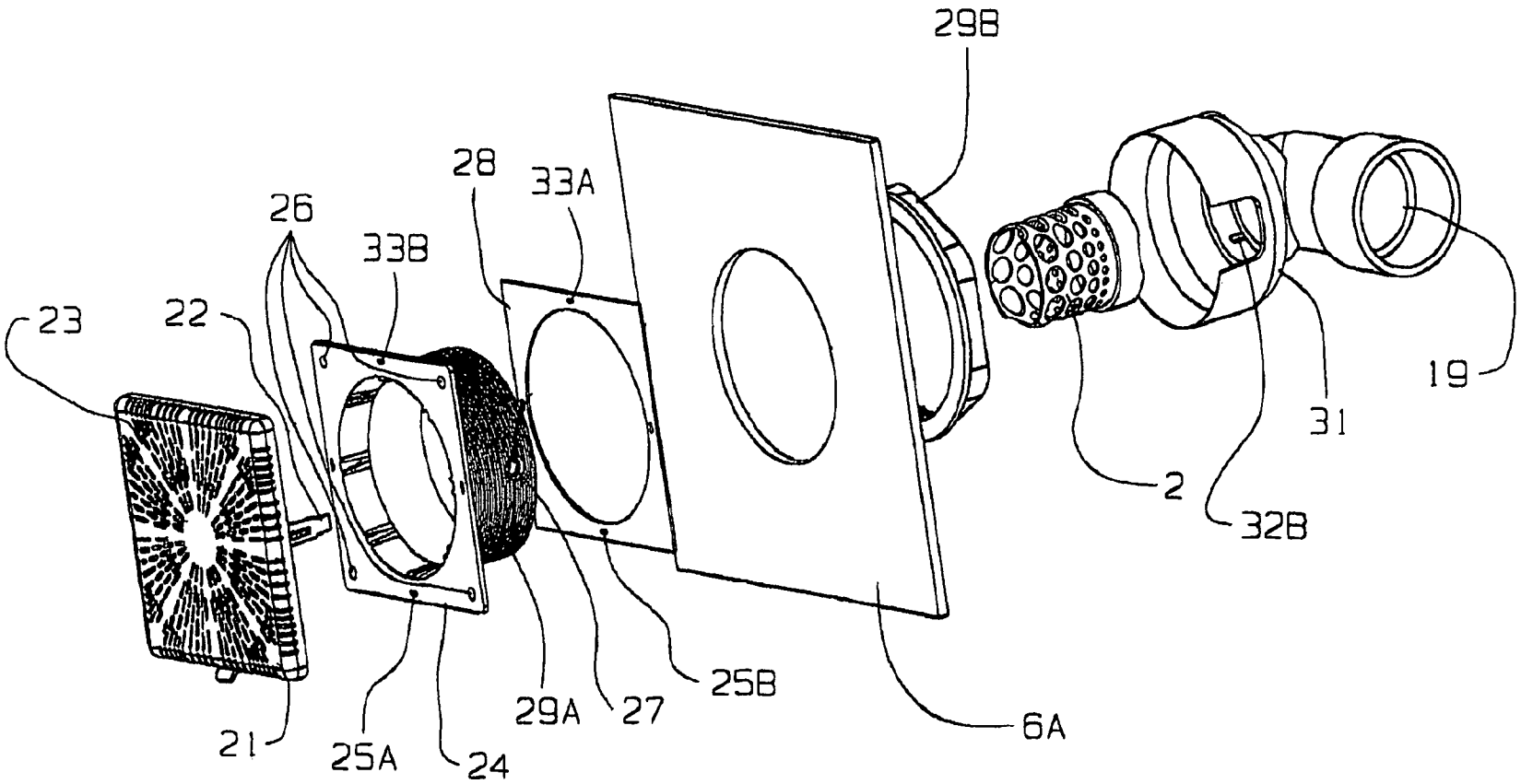
FIG. 2 is an exploded view of an embodiment of the faceplate and housing design for a suction filter apparatus and an embodiment of the suction filter apparatus.

FIG. 2 is an exploded view of an embodiment of the faceplate and housing for a suction filter apparatus and the an embodiment of the suction filter apparatus. The faceplate 21 is preferably rectangular but could have any shape.

The faceplate housing 24 is attached to the inside surface of tub wall 6A by mounting the threaded portion 29A of faceplate housing 24 through gasket 28, wherein the female fittings 25A, 33B on faceplate housing 24 receive the male end 25B, 33A on gasket 28. The housing 24 is secured in placed by nut 29B on the outer surface (back side) of the tub wall 6A via a standard size-opening cut. Support rib 35 extends from faceplate 21 having slots 23 and slidably fits into receiving notch 56 (see FIG. 9). Any of four cavitation port fins 22 slidably fit into receiving bracket 37 to cover the cavitation port hole 44. Magnets 26 hold faceplate 21 to the faceplate housing 24. The faceplate is thus mounted inside tub 6. The faceplate 21 is preferably square but could have any shape.

Figures 5A, 5B, 5C:
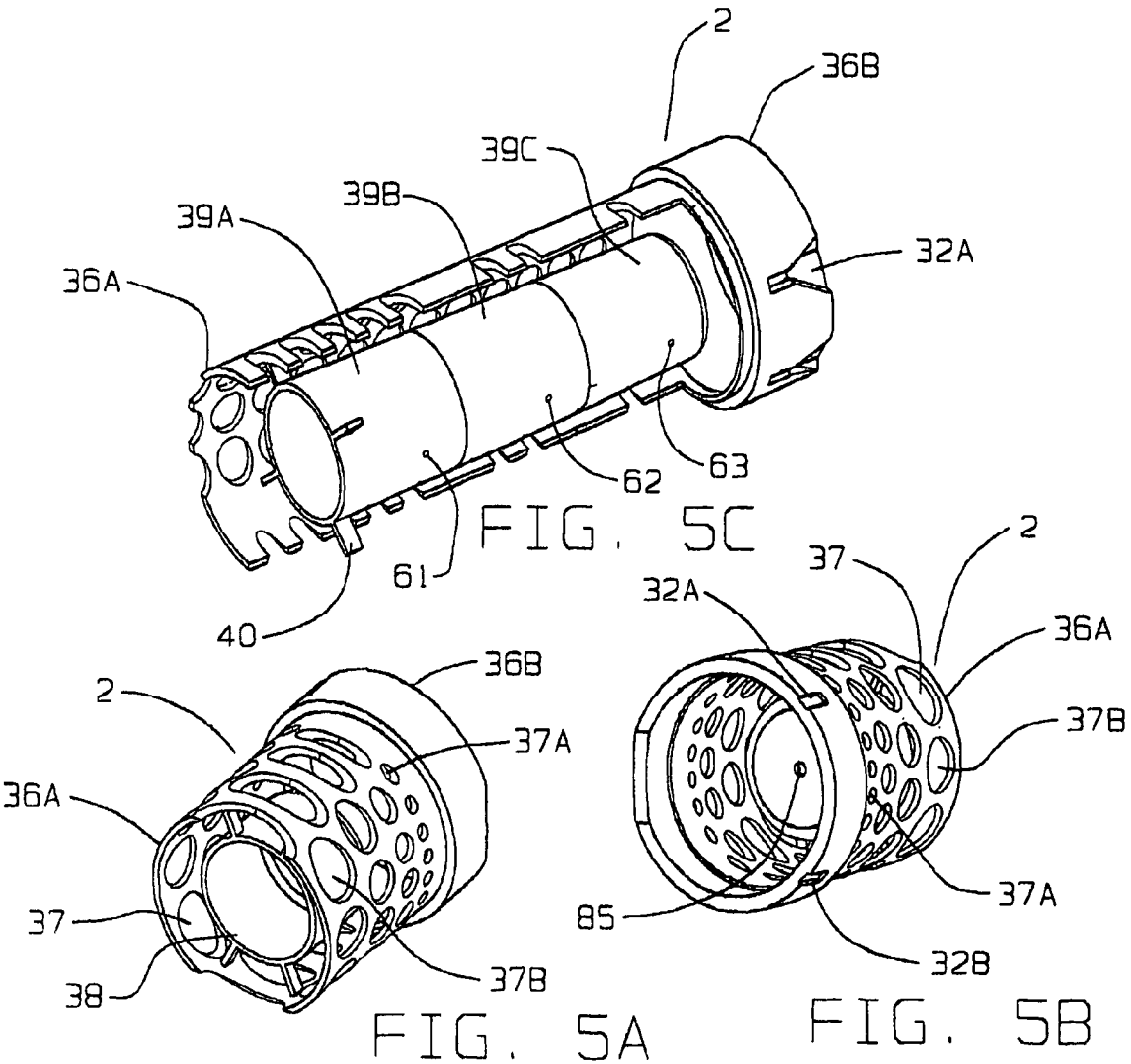
FIG. 5A is a top perspective view of one embodiment of the suction filter core.
FIG. 5B is a view from the opposite perspective view of the FIG. 5A suction filter core.
FIG. 5C is a top perspective view of another embodiment of the suction filter core depicting multiple chambers therein.

Filter core 2 is attached to filter housing 31 by male ridges 32B which fit into receiving slots 32A on filter core 2 (see FIGS. 5B, 2). Water passes through filter core 2 and pump outlet 19, whereby the filtered water circulates back into the water vessel system. The filter housing 31 is attached to the inner tub wall 6A via screw nut 29B.

Figure 3B:
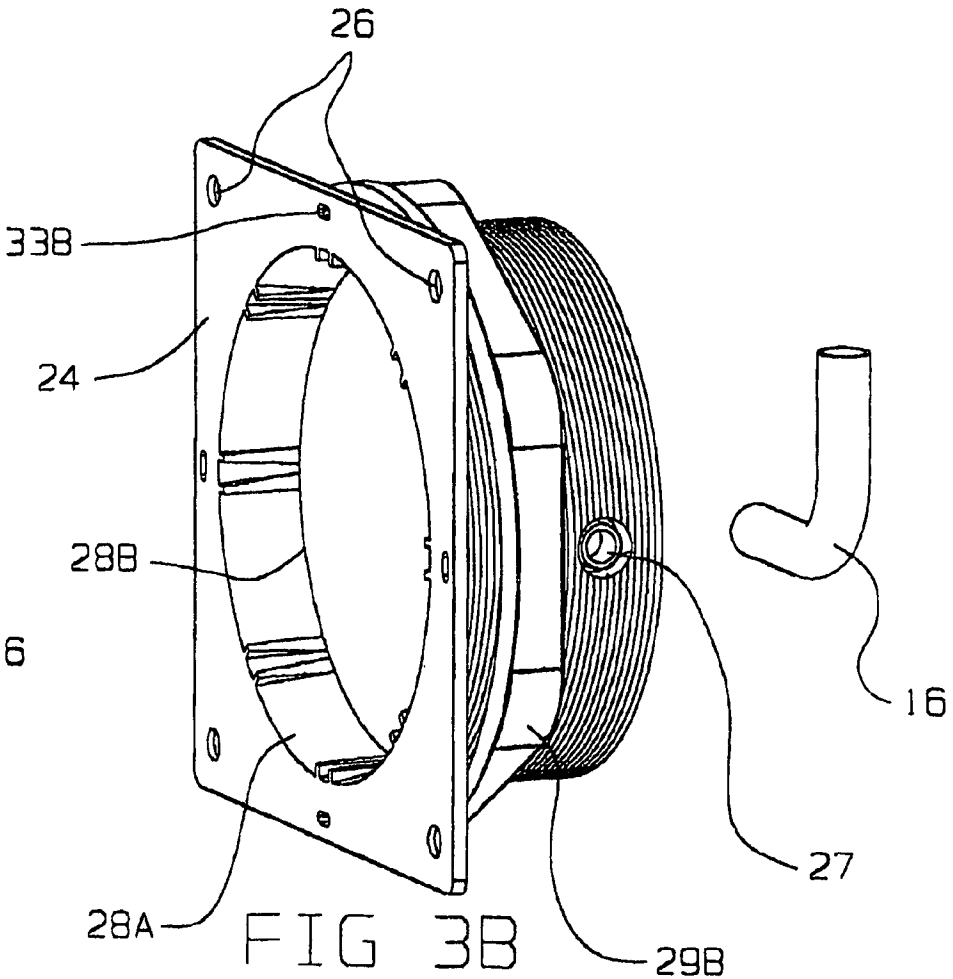
FIGS. 3A, 3B are right side perspective views of the faceplate housing shown in FIG. 2.
Figure 3A:
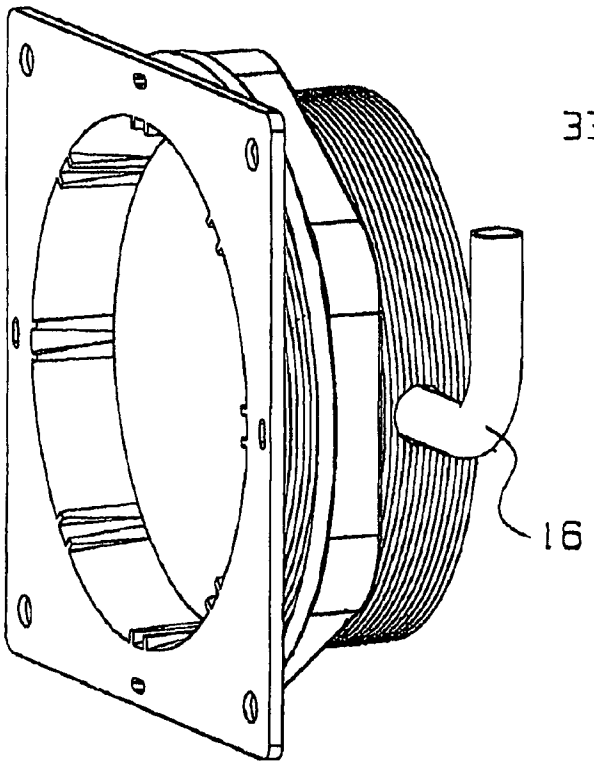

FIGS. 3A, 3B are right side perspective views of the faceplate housing shown in FIG. 2. Faceplate housing 24 has a sloped taper 28B (high end) to 28A (low end) to allow water to drain back into the tub after shutdown as shown in FIG. 3B. Recessed port 27 receives faceplate sensing cavitation line 16. FIG. 3A shows faceplate-sensing line 16 mounted on faceplate housing 24.

FIGS. 4A, 4B, 4C, 4D present different perspective views of faceplate 21 having a pull tab 45 which facilitates the removal of the faceplate 21 if desired. The faceplate slots 23 which are designed and engineered in a radiating pattern allow a larger volume of water to pass through the faceplate 21, thereby entering filter housing 31.

Figure 4B:
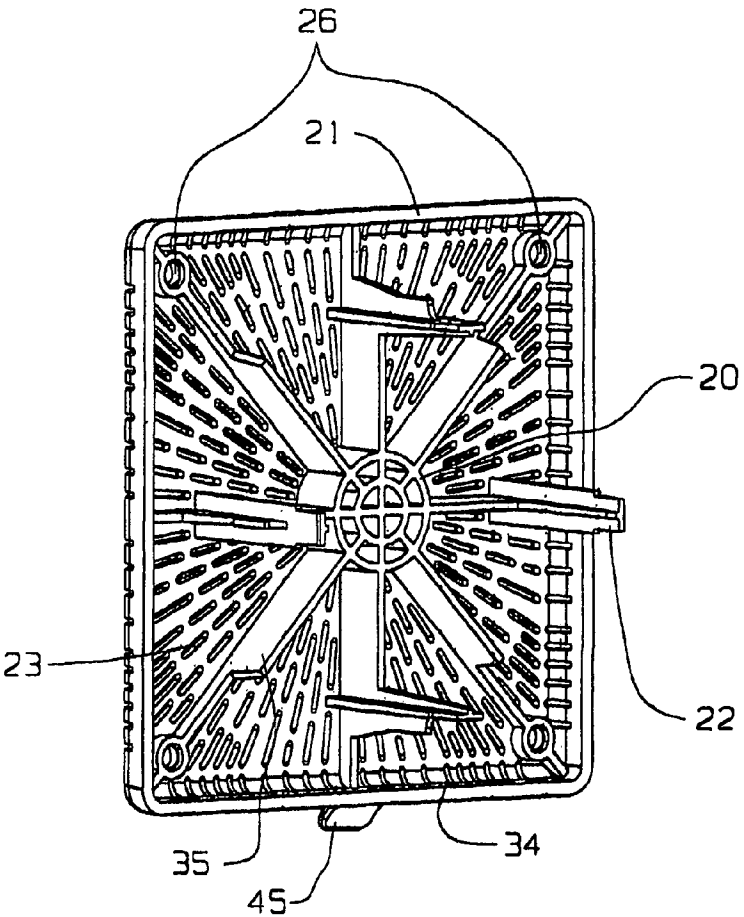
FIGS. 4A, 4B, 4C, 4D present different perspective views of a faceplate embodiment having a pull tab to facilitate the faceplate removal if desired.
Figure 4A:
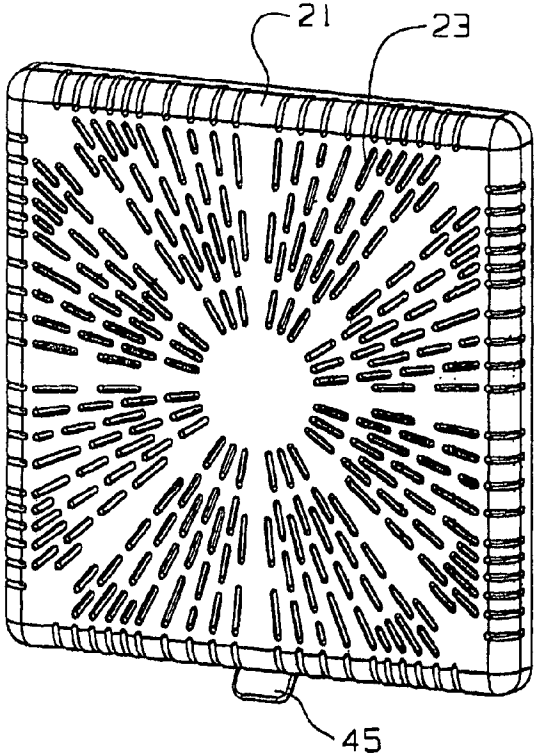
Figure 4D:
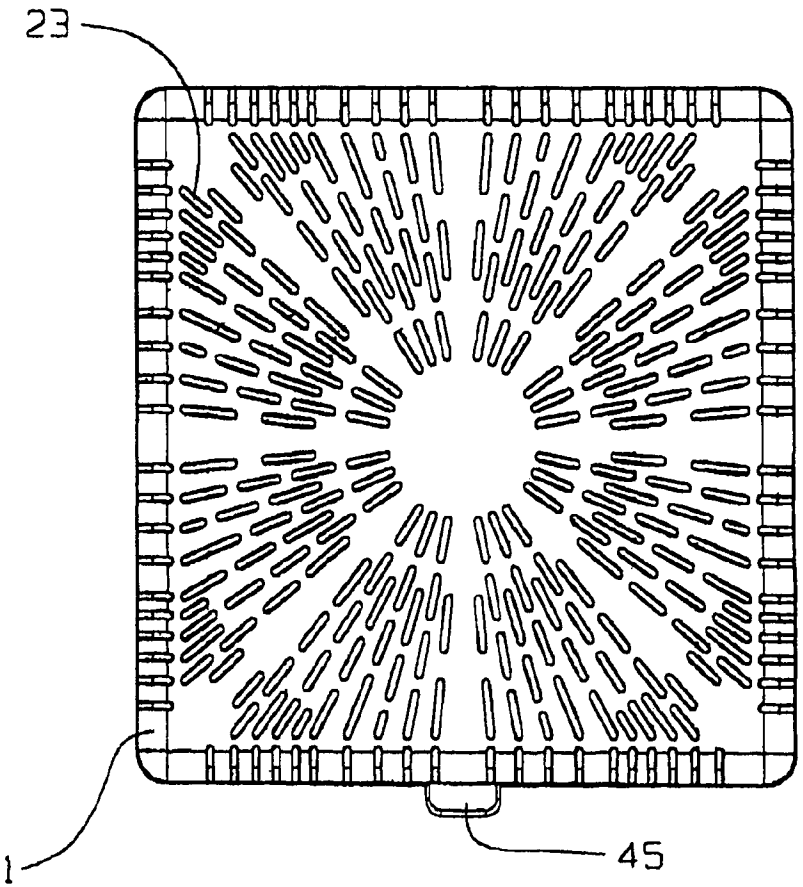
Figure 4C:
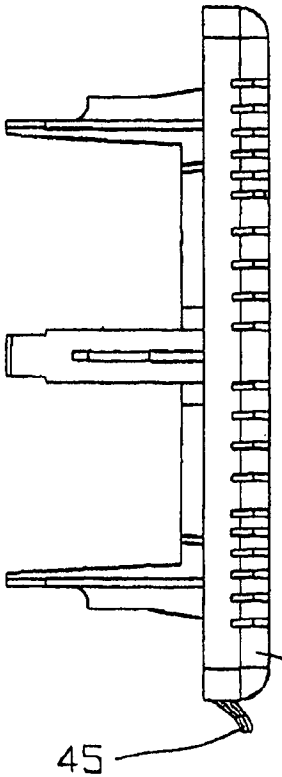

As shown in FIG. 4B, the rear of the faceplate 21 has support ribs (also known as support bars) 35 to strengthen the antivortex center support 20 to prevent crushing. Drain slots 34 on faceplate 21 allow water to drain back into the tub after shutdown as shown in FIG. 4B. A cavitation port fin 22 is located in at least four positions on the rear of faceplate 21. Providing multiple cavitation port fins 22 facilitates the mounting of the faceplate 21 on the housing 24. Because each cavitation fin 22 slidably fits into receiving slot 56 to cover the cavitation port hole 44, it would not be necessary to dictate a particular fin or particular orientation of the faceplate 21 to mount onto the housing 24. Magnets 26 hold faceplate 21 to the faceplate housing 24.

FIGS. 5A, 5B illustrate an embodiment of the suction filter core 2. Filter core 2 is attached to filter housing 31 (see FIG. 2) by male ridges 32B on housing 31 which fit into receiving slots 32A on filter core 2. The filter core 2 is preferably an ABS pipe mountable in filter housing 31. One embodiment of the filter core plastic is injected with antimicrobial additives during the injected molding process to inhibit any bacteria growth on the core.

The filter core holes and slots (together known as apertures 37) range from small 37A at the outlet end 36B to large 37B at the closed end opposite the outlet end 36B. The larger perforation sizes on the end opposite the outlet end 36B distribute the water flow across the entire length of the filter media 53,54. Without the enlarging feature of the varying apertures, the water would only be filtered by a small portion of the filter media 53,54 near the outlet 36B.

The filter core 2 has an antimicrobial chamber 38 that houses antimicrobial additives such as slow dissolving chlorine, bromine, or a variety of other antimicrobial additives. Antimicrobial chamber 38 has an adjusting bleeder hole opening 85 from which the additive exits into the water that can be increased or decreased by turning the main body of the antimicrobial chamber 38 in one direction or another, wherein the more the antimicrobial chamber is screwed on, the smaller the hole opening 85 becomes. Although the one embodiment antimicrobial chamber has one hole, multiple holes or slots can be used. In addition, the configuration, size, and location of the singular or multiples bleeder holes or slots may vary.

FIG. 5C is a top perspective view of another embodiment of the suction filter core 2 depicting multiple chambers therein. Alternate chambers 39B, 39C may be added on the filter core 2 along with antimicrobial chamber 39A for the addition of other additives such as ion exchange resins for water softening, fragrances, or the like. Chamber support 40 prevents crushing. The corresponding additives exit chambers 39A, 39B, 39C into the water from bleeder holes 61, 62, 63. Additional alternate chambers may be included if desired.

As shown, the alternate embodiment antimicrobial chamber 39A is located furthest from the outlet end 36B. However, it may be configured at any location within filter core 2. Just as one embodiment of the antimicrobial chamber 38 may have multiple bleeder holes or slots of varying configurations, sizes, and locations, the embodiment having alternate chambers may include variations from which additives may exit or bleed from.

Figure 6A:
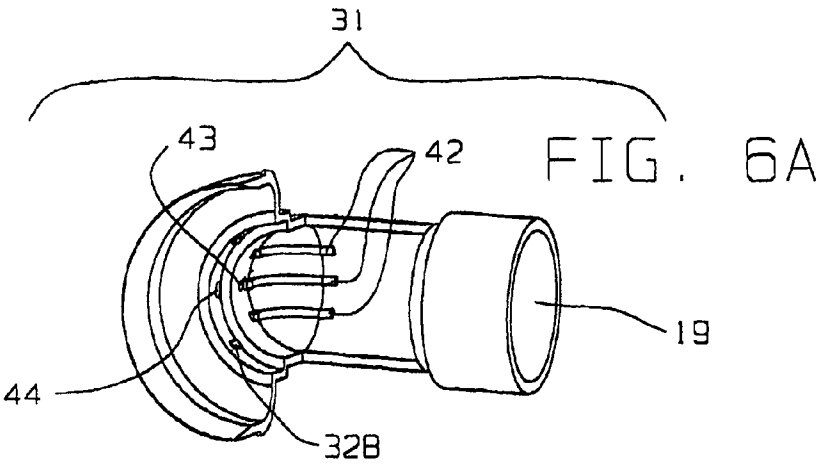
FIG. 6A is a cutaway plan view of the suction filter core housing shown in FIG. 2.
Figure 6B:
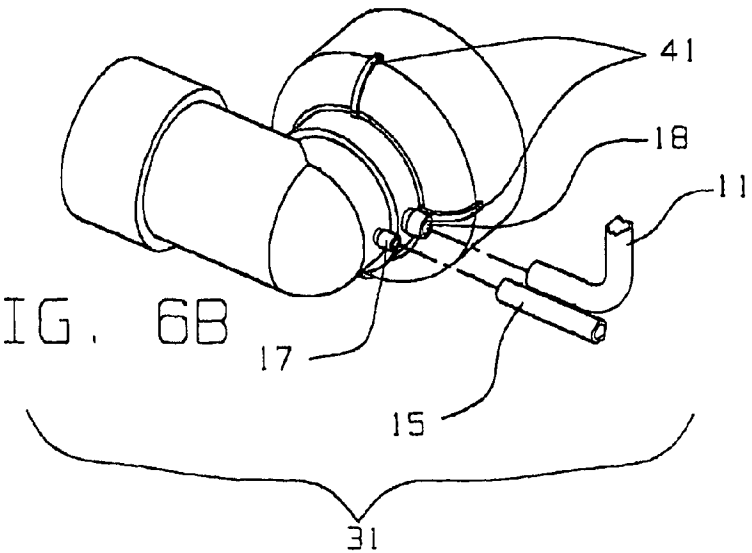
FIG. 6B is a rear plan view of the suction filter core housing showing a non-electric cavitation porthole.

Referring next to FIGS. 6A, 6B, the rear portion 400 of filter housing 31 is curved at the top rear wall 80 and generally shaped like a half-cylinder when integrated with the bottom rear 81. The front portion of the elbow shaped filter housing 31 can be connected to a suction drain of a water circulation system that requires a relatively high rate of intake water flow. Housing 31 is readily installed into a standard size opening cut or formed into the tub wall 6A (see FIG. 1). Housing stop 41 prevents the filter housing 31 from protruding too far past the inner tub wall 6A. Filter core 2 (see FIGS. 5A, 5B, 5C) is attached to filter housing 31 by male ridges 32B on housing 31 which fit into receiving slots 32A on filter core 2. Water passes through filter core 2, bypasses the antivortex ridges 42 and through pump outlet 19, whereby the filtered water circulates back into the water vessel system.

As shown in FIG. 6B, antimicrobial additives enter the water system via antimicrobial line 15 connected to the additive port 17 through additive hole 43 (see FIG. 6A), which lies adjacent to the port hole for the filter sensing cavitation line 11. The filter sensing line 11 is connected to the filter cavitation port 18.

Figures 8, 8A, 8B, 8C, 8D:
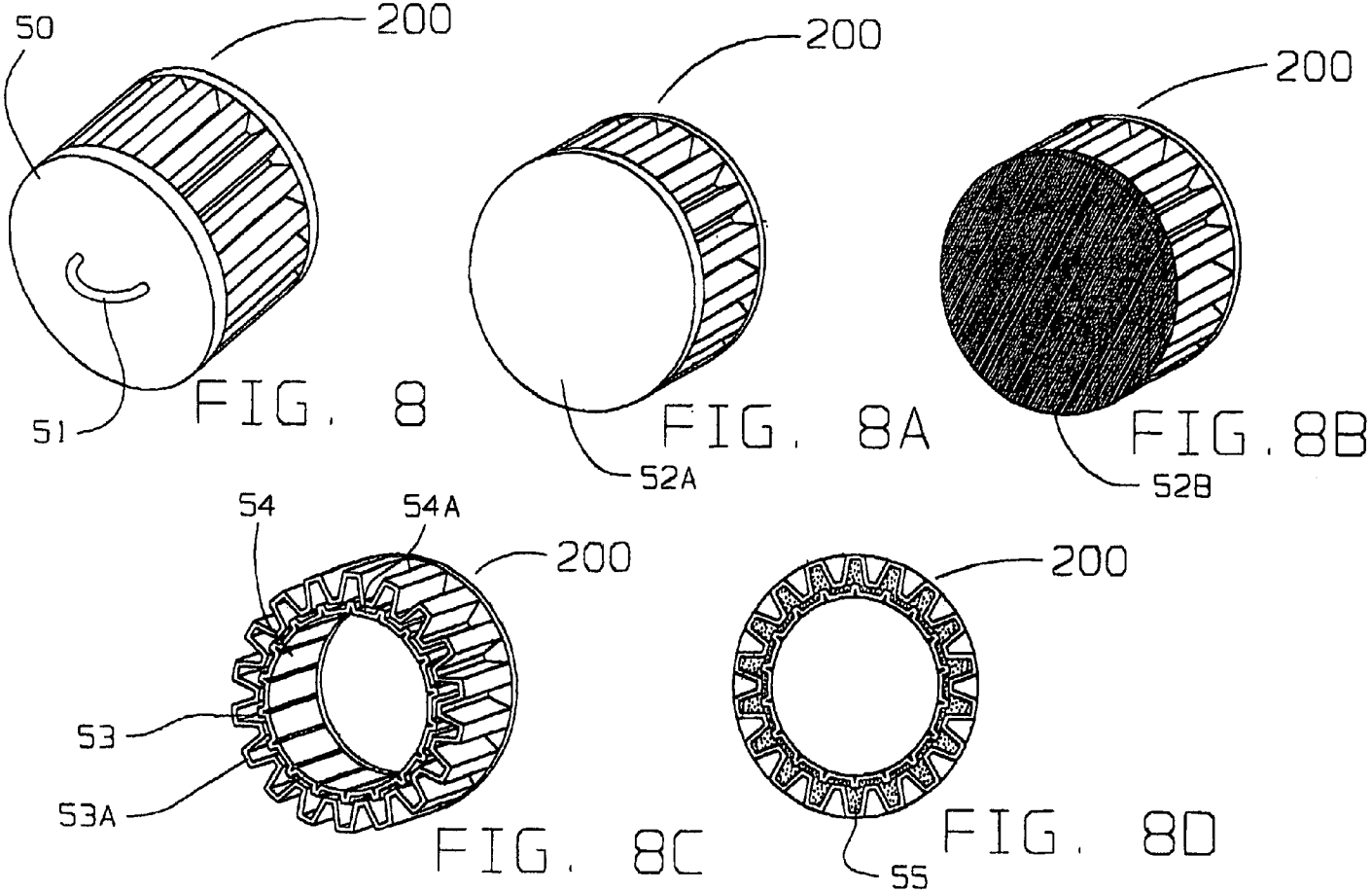
FIG. 8 is a top perspective view of a suction filter with end cap for the suction filter assembly.
FIG. 8A is a perspective view of another embodiment of the suction filter end cap depicting a first color indicator, wherein the first color indicates the usability of the filter.
FIG. 8B is a perspective view of the embodiment of FIG. 8A depicting a second color indicator, wherein the second color indicates the replaceability of the filter.
FIG. 8C is a rear perspective view of the FIG. 8 suction filter end cap.
FIG. 8D is a rear plan view of the FIG. 8 suction filter end cap.

FIG. 8 is a top perspective view of a suction filter 200 with end cap 50, preferably rubberized. Pull-tab 51 facilitates the removal of the filter 200.

The end cap embodiments of FIGS. 8A, 8B illustrate the use of color as an indicator for filter replacement. The first color 52A would indicate the filter is not ready for replacement. The second color 52B would indicate the filter should be replaced.

FIG. 8C is a rear perspective view of the FIG. 8 suction filter end cap showing an embodiment with a two stage pleat filter media having outer filter media chamber 53 and inner filter media chamber 54. Outer pleat 53A of outer chamber 53 has larger pleat holes, which allow larger sized particles and debris to pass through its antimicrobial treated filter pleat. Inner pleat 54A of inner chamber 54 has smaller openings which allow only microscopic debris particles to pass through its treated filter pleat. The inner chamber's pleat media 54A captures the particles which pass through the outer chamber pleat media 53A. Preferably the outer and inner filter media is polypropylene or other media that will accept antimicrobial agents.

In FIG. 8D, debris 55 is shown captured in the spaces between the inner and outer pleats. However, since outer media 53A and inner media 54A are impregnated with antimicrobial agents, any accumulation of bacteria in debris 55 would be killed by the antimicrobial effects.

Figure 9:
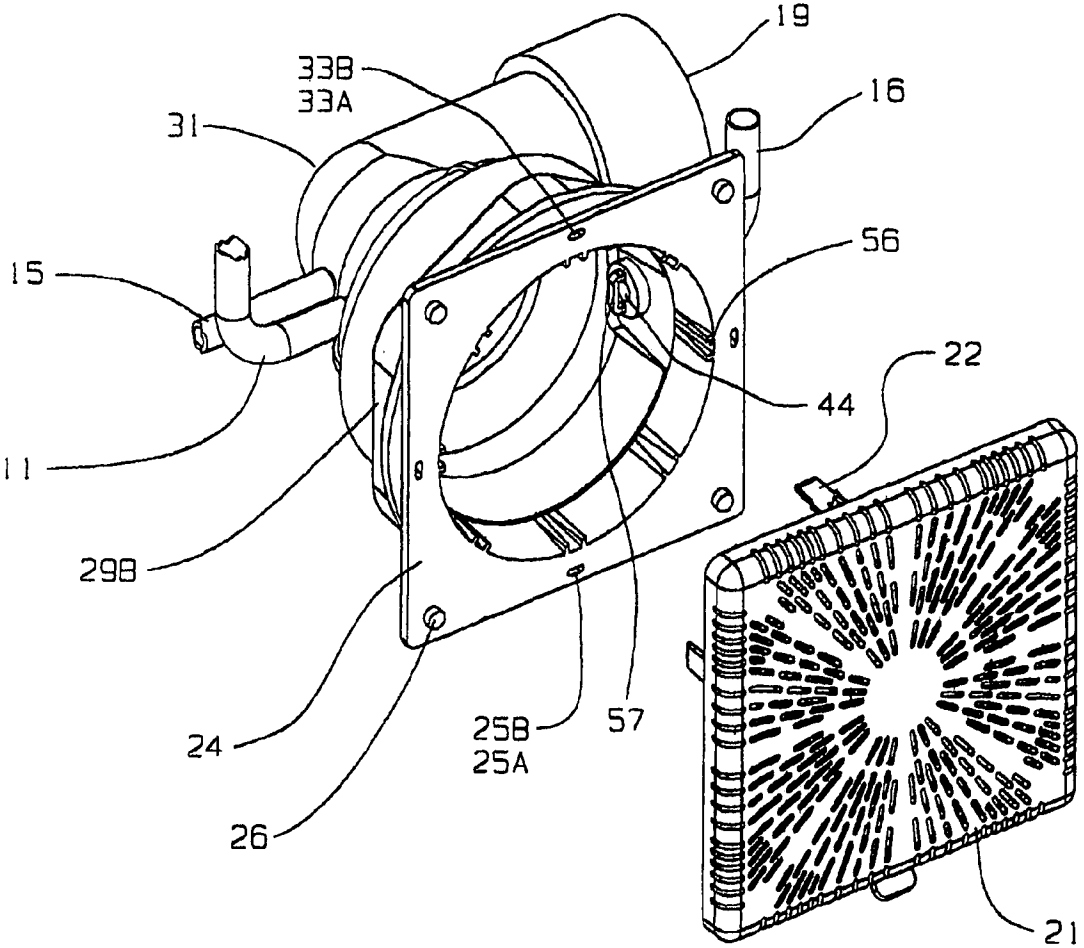
FIG. 9 is a top perspective view of the housing and faceplate design for a suction filter apparatus.

FIG. 9 is a top perspective view of the housing and faceplate design for a suction filter apparatus. In fact, FIG. 9 shows how the exploded components shown in FIG. 2 are assembled. The faceplate housing 24 is attached to the inside surface of tub wall 6A (not shown) wherein the female fittings 25A, 33B on faceplate housing 24 receive the male end 25B, 33A on gasket 28 (see FIG. 2). The housing 24 is secured in placed by nut 29B on the outer surface (back side) of the tub wall 6A. The appropriate cavitation port fin 22 (see FIGS. 10,11) extends from faceplate 21 and slidably fits into receiving notch 56 through receiving bracket 57 to cover the cavitation port hole 44. Magnets 26 hold faceplate 21 to the faceplate housing 24.

Figure 11:
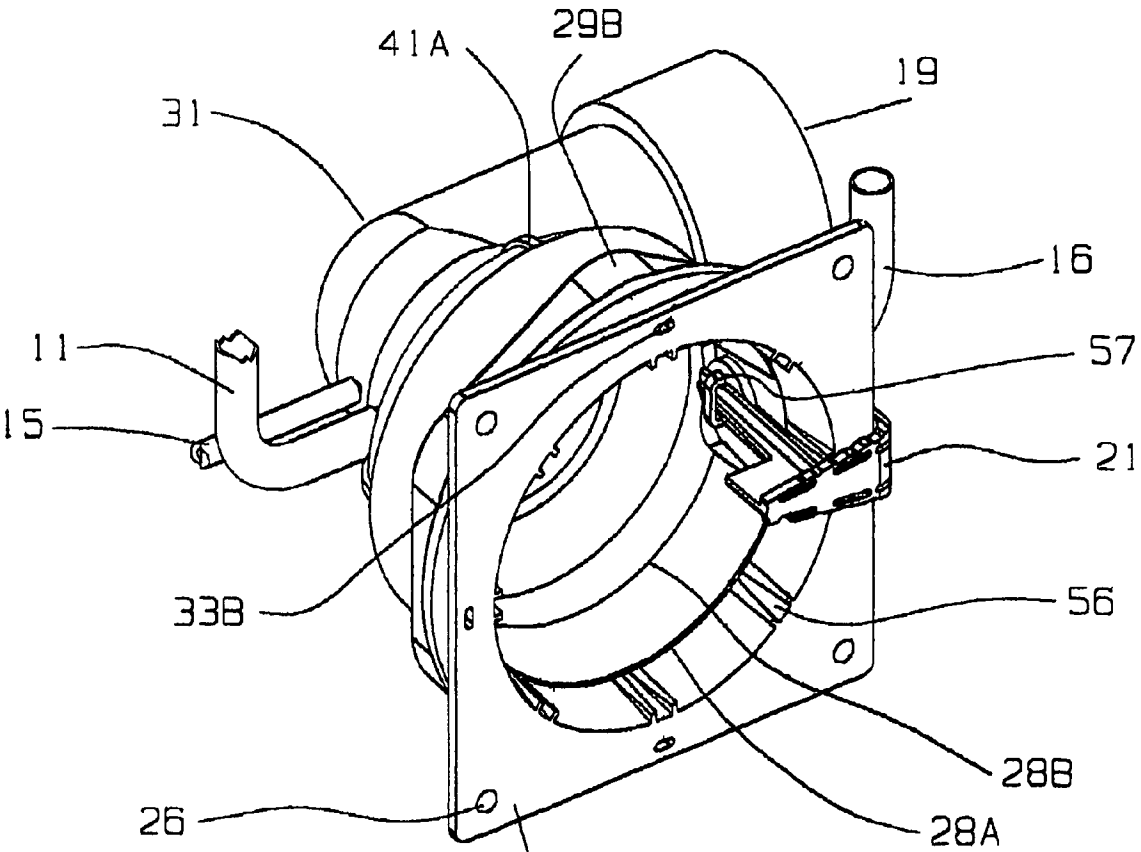
FIG. 11 is the same view as FIG. 9 with an embodiment of a faceplate fin shown inserted into a receiving bracket of the suction filter core housing, thereby enabling a seal over the non-electric cavitation porthole.

FIG. 11 is the same view as FIG. 9 with a cutaway view of faceplate 21 exposing cavitation port fin 22. Cavitation port fin 22 is shown inserted into receiving bracket 57 of filter housing 31, thereby enabling a seal over the non-electric cavitation porthole 44. Faceplate housing 24 has a sloped taper 28B (high end) to 28A (low end) to allow water to drain back into the tub after shutdown.

Figure 12:
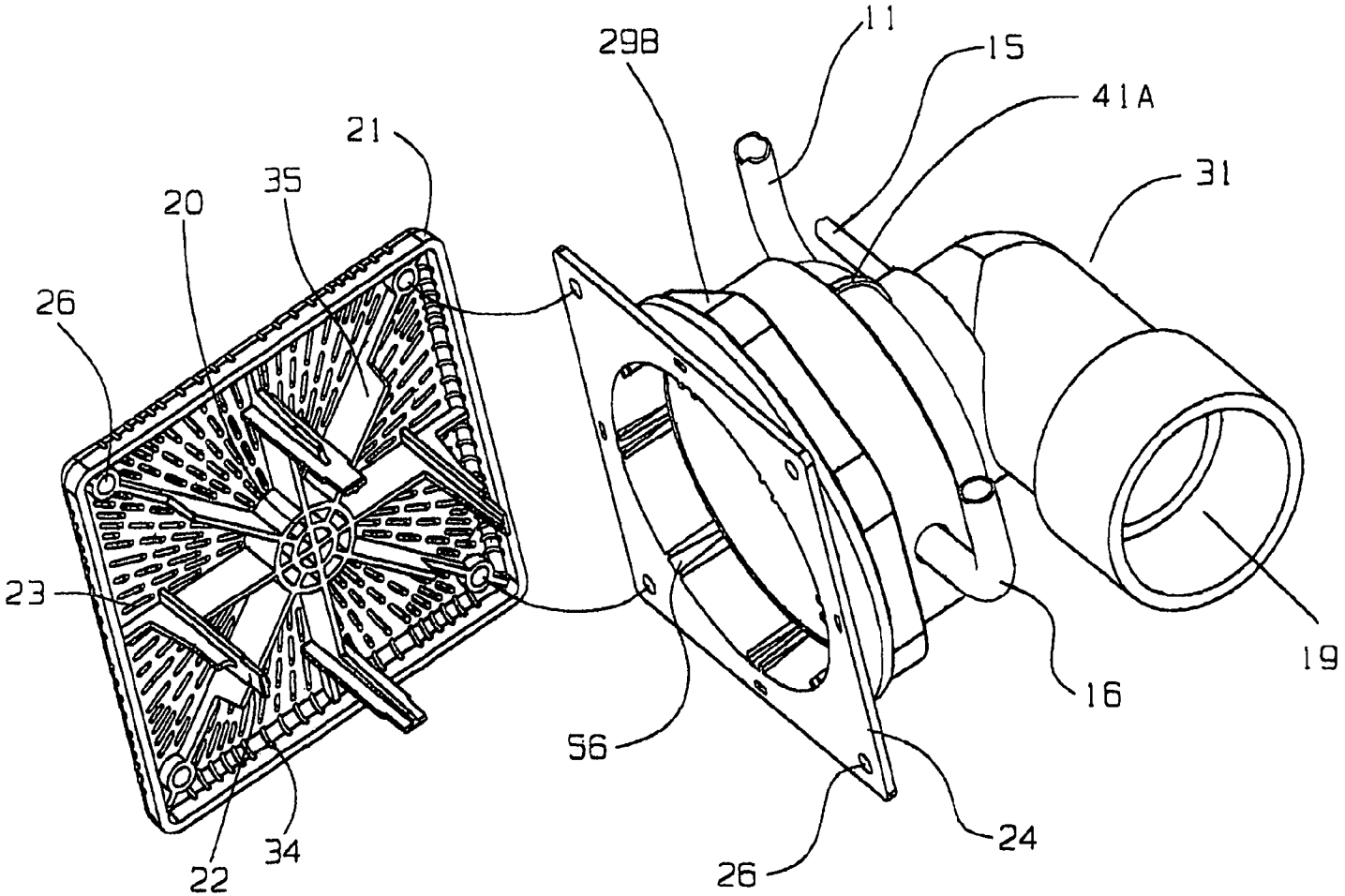
FIG. 12 is a top perspective exploded view of an embodiment of the faceplate housing and faceplate design for a suction filter apparatus.

FIG. 12 is similar to FIG. 9. Where FIG. 9 depicts the front side of faceplate 21, whereby magnets 26 attach the faceplate 21 to housing 24, FIG. 12 depicts the rear side of faceplate 21.

Figure 10:
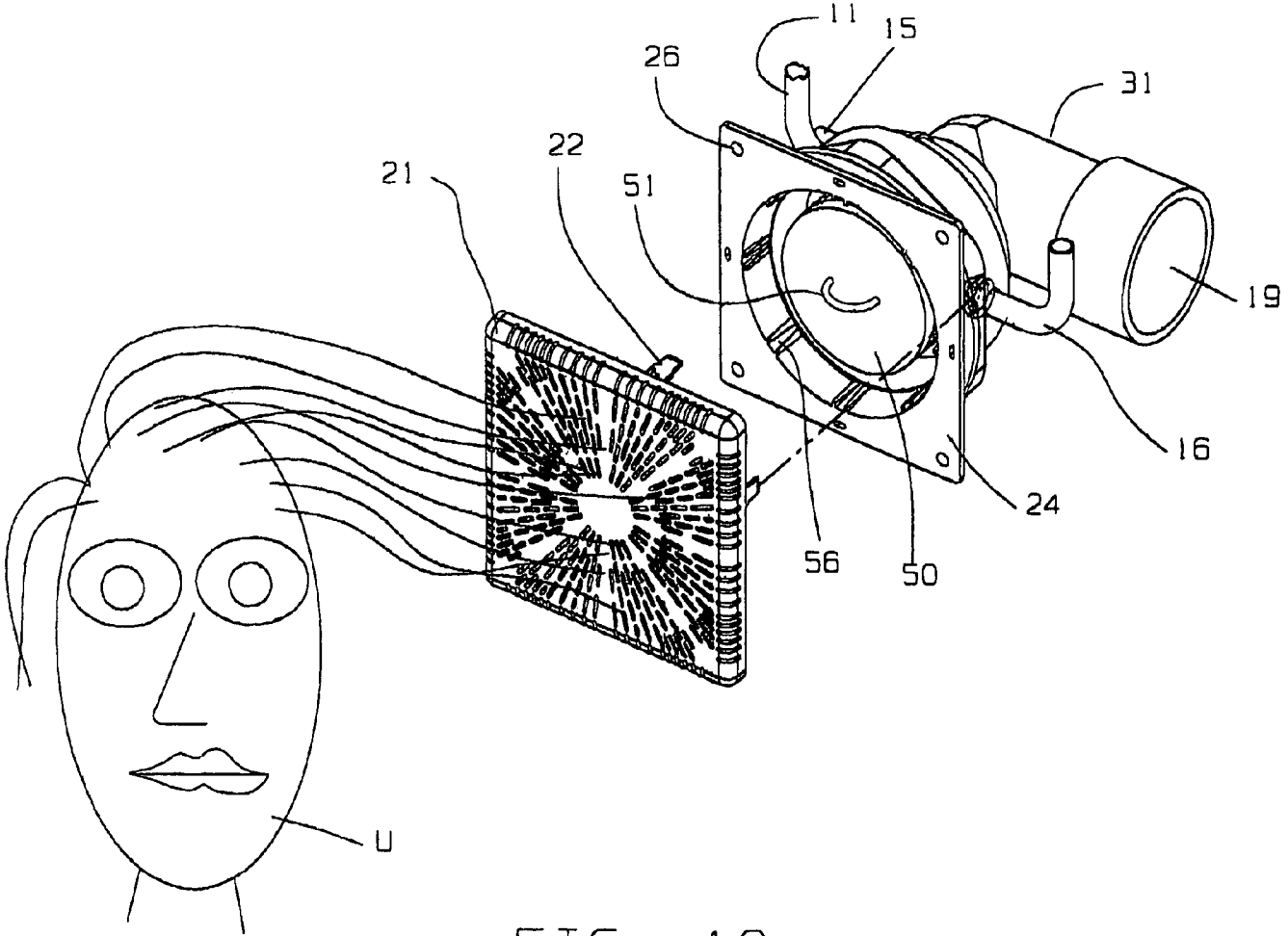
FIG. 10 is an top perspective exploded view of a user getting her hair entrapped in an embodiment of the faceplate/housing design, wherein only the magnets hold the faceplate to the housing, and an end cap with pull tab design, thereby enabling a safety oriented pop off faceplate and pull out filter.

FIG. 10 is an top perspective exploded view of a user U getting her hair entrapped in an embodiment of the faceplate 21/housing 24 design, wherein only the magnets 26 hold the faceplate 21 to the housing 24, thereby enabling a safety pop off design. Pulling the faceplate 21 out will cause the cavitation port fin 22 to slidably detach from receiving notch 56 and expose cavitation port hole 44 to air. Once air from the faceplate sensing cavitation line 16 is drawn into the pump 3, pump 3 would cavitate. Therefore, pump cavitation is triggered when the faceplate sensing cavitation line 16 detects a missing or broken faceplate 21.

Likewise, when filter sensing line 11 detects a missing filter, pump cavitation occurs. User U can easily remove the filter assembly by using the end cap pull tab 51 to pull the end cap 50 and filter 200 out, thereby causing pump cavitation. The filter sensing line 11 is connected to the filter cavitation port 18 (see FIGS. 6A, 6B).

Figure 13:
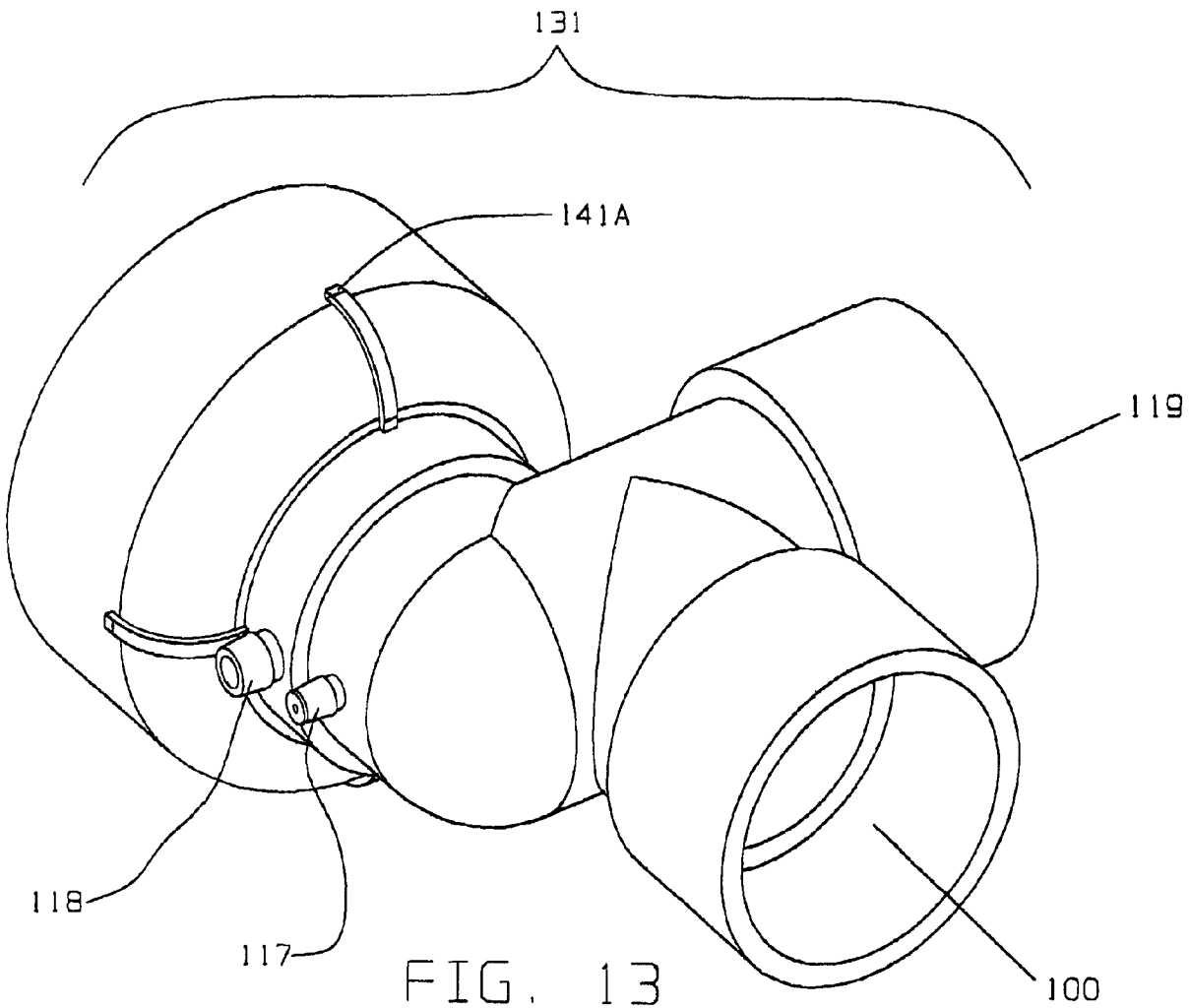
FIG. 13 is a rear perspective view of another embodiment of the housing for a suction filter apparatus showing a skimmer outlet and a pump outlet.

FIG. 13 is a rear perspective view of another embodiment of the housing for a suction filter apparatus showing skimmer outlet 100 and pump outlet 119. Although spas also have skimmer filters that draw surface water through the filters into a pump and back through the jets, the majority of the water passing through other suction points bypasses the skimmer filters. The alternate embodiment orifice 131 can be hooked up in tandem to a skimmer filter in a spa to filter water that bypasses the skimmer filter. Antimicrobial additives enter the water system via the additive port 117 adjacent to the filter cavitation port 118.

Figure 16:
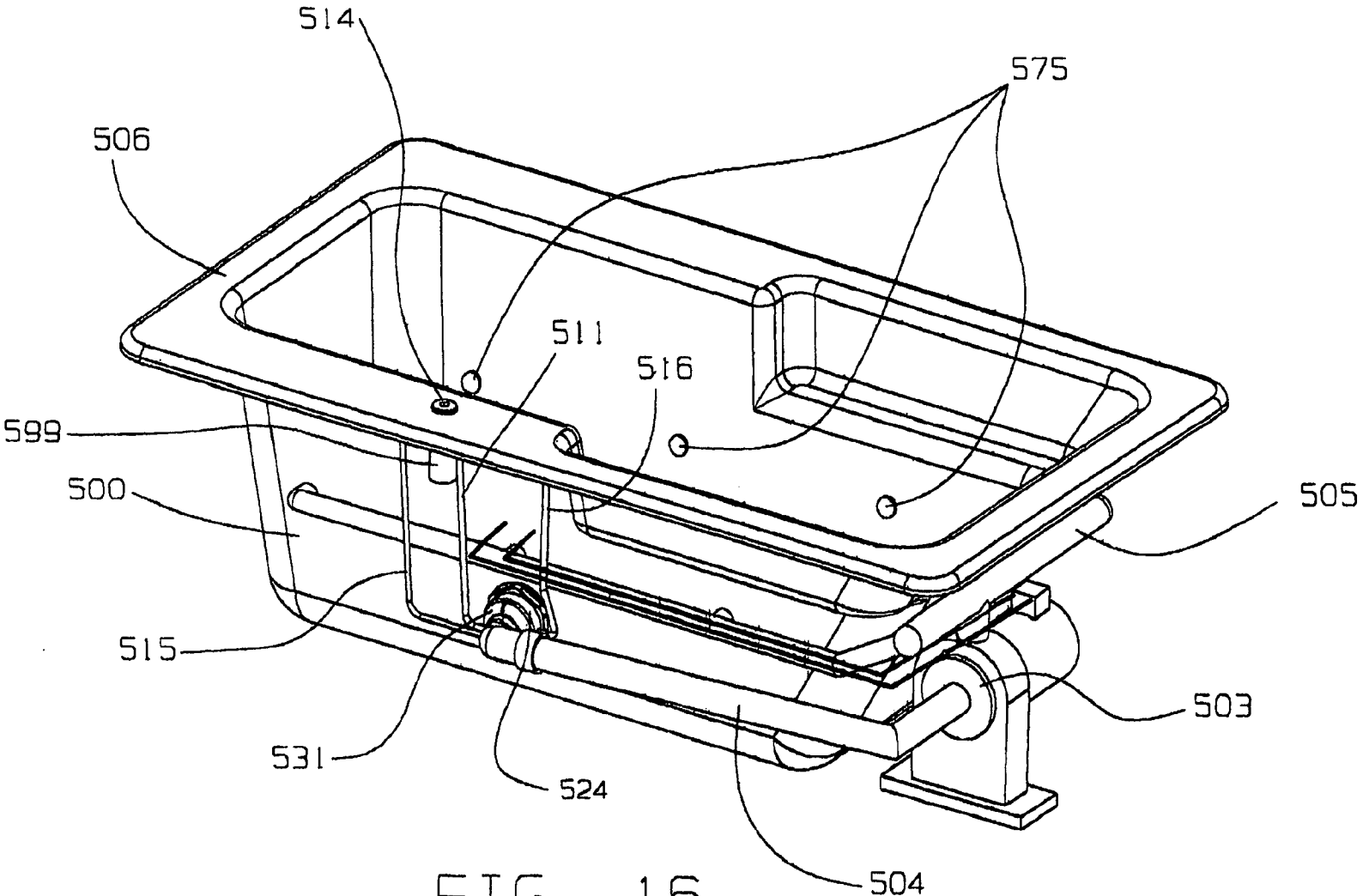
FIG. 16 is a top perspective view of an alternate embodiment of the present invention, wherein each water vessel component is impregnated with antimicrobial additives creating a total water vessel sanitation system.

FIG. 16 is a top perspective view of an alternate embodiment of the present invention, wherein each water vessel component is impregnated with antimicrobial additives creating a total water vessel sanitation system. The total water vessel sanitation system uses components that have been manufactured using antimicrobial additives including but not limited to the fiberglass/resin vessel backing 500, acrylic sheet 506, pump 503, jets 575, inlet pipe 504, outlet pipe 505. Treated filter sensing cavitation line 511 and treated faceplate sensing cavitation line 516 extend from treated suction filter housing 531. As even the antimicrobial system components are treated, injector button 514 is depressed to activate the antimicrobial additives dispenser 599 that delivers antimicrobial additives to the water vessel covered by acrylic sheet 506 via antimicrobial line 515. One embodiment is impregnated with at least one of the components of a non-leaching antimicrobial agent selected from the group consisting of 2,4,4-trichloro-2-hydroxy diphenol ether and 5-chloro-2phenol (2,4 dichlorophenoxy) compounds, see U.S. Pat. No. 6,540,916 (2003) to Patil (assigned to Microban Products Company, Huntersville, N.C.) at column 3, line 30.

The antimicrobial agent art is full of examples of agents, including silver (see Patil '916, column 2, line 58), zinc, cadmium, mercury, antimony, gold, aluminum, copper, platinum, and palladium; see U.S. Pat. No. 6,030,632 (2000) to Sawan et al. filed Sep. 11, 1998 and references cited therein.

Figure 17:
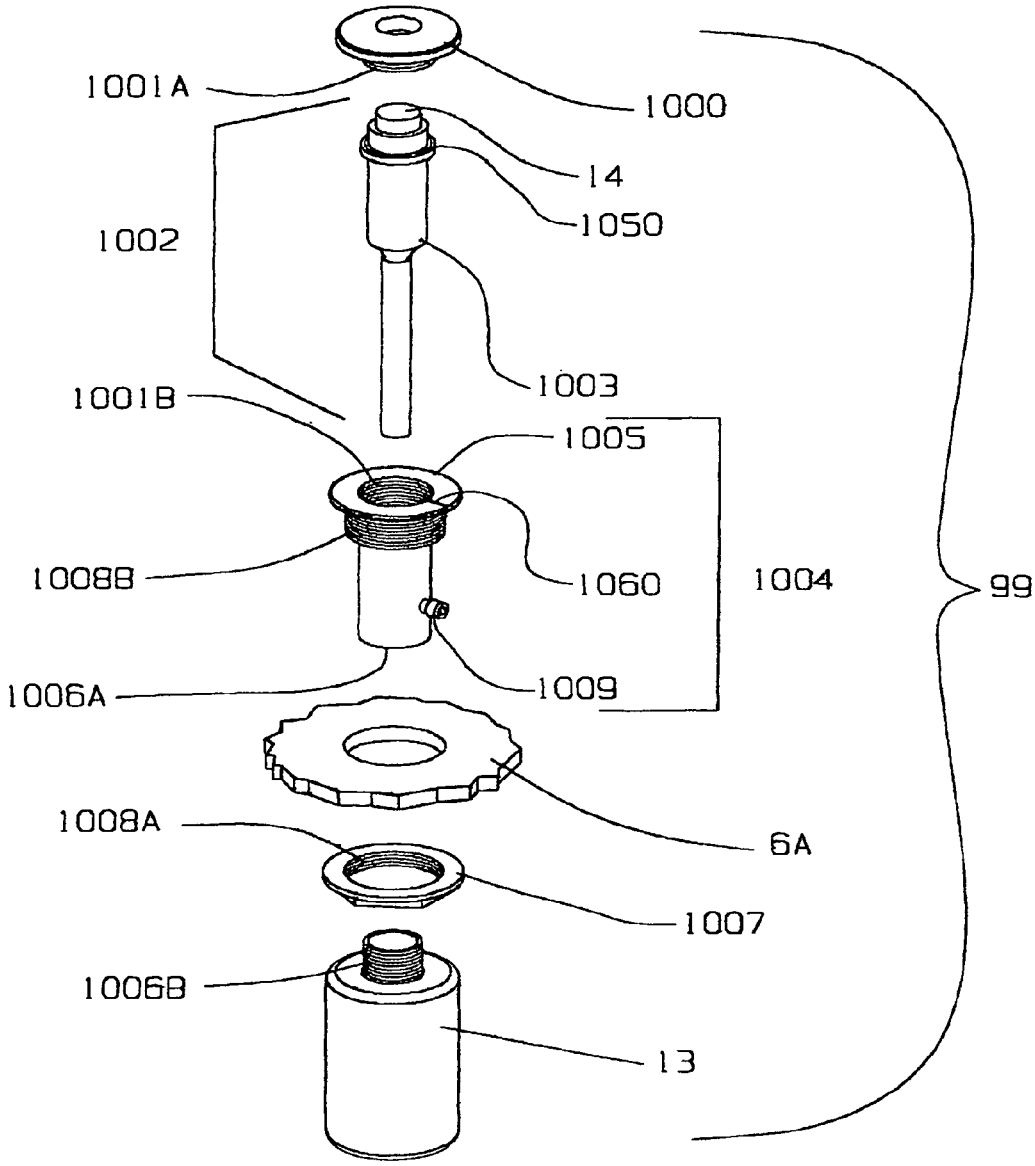
FIG. 17 is a plan exploded view of one embodiment of an injector button assembly for dispensing antimicrobial agents.
Figure 23:
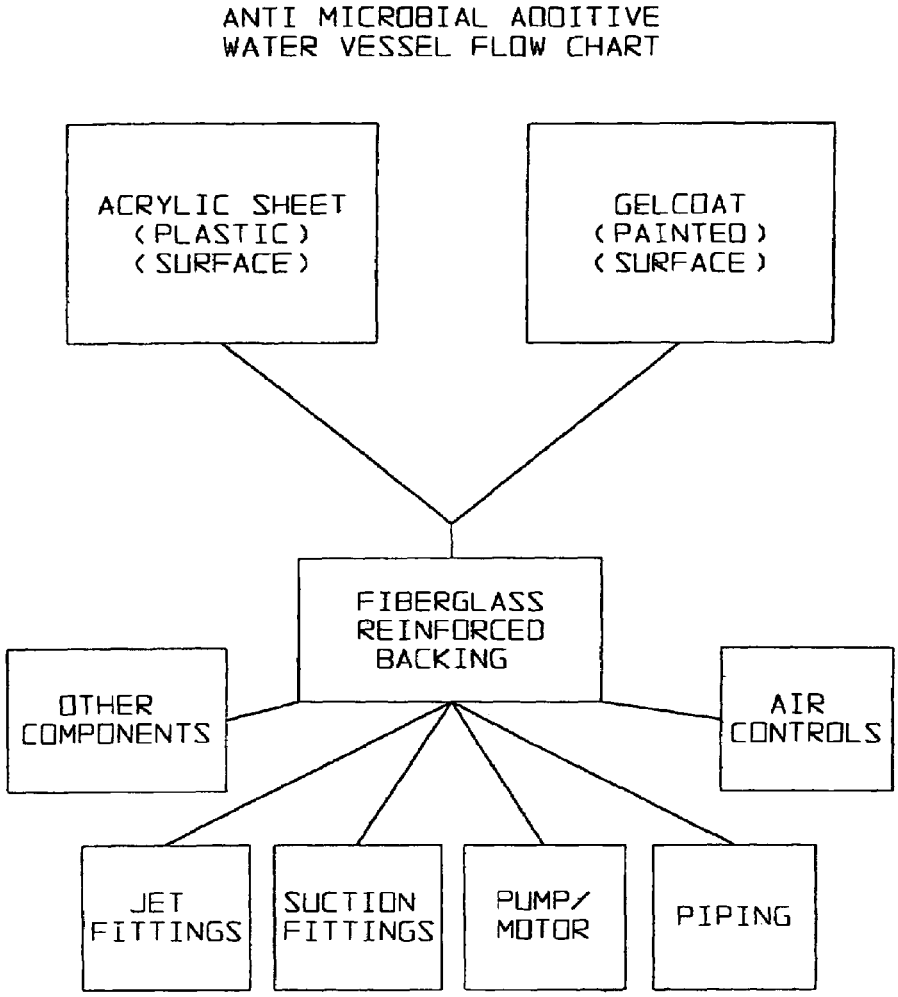
FIG. 23 is a flow chart illustration of a total water vessel sanitation system that includes antimicrobial additives in each component of the water vessel.

FIG. 23 presents a flow chart illustration of the total water vessel sanitation system of FIG. 16. Antimicrobial additives may be added to each component of the water vessel to provide for optimum bacteria reduction in a water vessel system. The acrylic sheet or gelcoat surface may be treated at point of manufacture. In addition, fiberglass reinforced backing, air controls, jet fittings, suction fittings, pump, motor, piping and other components may treated with antimicrobial additives to provide for optimum protection from bacteria FIG. 17 is a plan exploded view of one embodiment of an injector button assembly for dispensing antimicrobial agents. Antimicrobial dispenser 99 is a deck mount top fill design. Injector assembly housing 1004 is fitted into the deck wall 6A of a tub through a standard size opening cut. Flange nut 1007 having flange nut threads 1008A is mounted onto antimicrobial reservoir 13 positioned on the underside of the deck of the tub wall 6A. Inner tube injector assembly threads 1006A secure reservoir 13 under tub wall 6A by way of reservoir threads 1006B while flange nut threads 1008A secure injector assembly housing 1004 by threading into its outer assembly housing threads 1008B. Inner tube injector port 1009 is thus located on the underside of the deck of the tub wall 6A. Sub-assembly 1002 is inserted into the open end of injector assembly housing 1004 atop the deck of tub wall 6A, wherein the antimicrobial pick up tube resides within reservoir 13 and sub-assembly injector port 1003 aligns with inner tube injector port 1009 by means of aligning line 1050 on the pick up housing 2004 of sub-assembly 1002 with line 1060 on injector assembly housing flange 1005. Button cover 1000 having button cover threads 1001A is mounted through its center hole over sub-assembly 1002 onto injector assembly housing flange 1005 and tightened by screwing button cover threads 1001A into assembly housing threads 1001B within inner assembly housing 1004. Button cover 1000 and injector button 14 are exposed at the deck of tub wall 6A (see FIG. 1).

Figure 18:
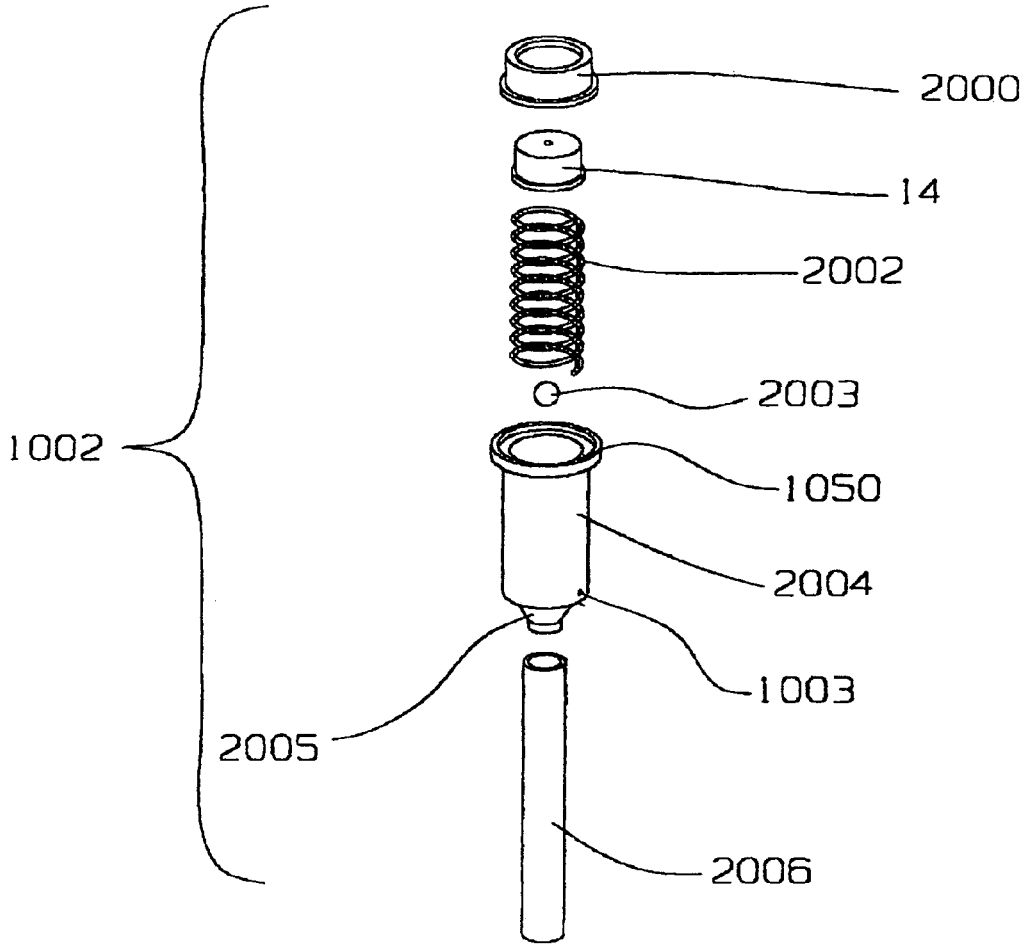
FIG. 18 is a plan exploded view of one embodiment of the injector sub-assembly shown in FIG. 17.

FIG. 18 is a plan exploded view of one embodiment of the injector sub-assembly 1002 shown in FIG. 17. Button retainer 2000 fits over injector button 14. Spring 2002 and check ball 2003 reside within pick up housing 2004 having an open end and a tapered check ball seat 2005. Sub-assembly injector port 1003 is located on pick up housing 2004 adjacent to check ball seat 2005. Antimicrobial pick up tube 2006 fits into the tapered end of pick up housing 2004 abutting check ball seat 2005. Upon assembly, sub-assembly 1002 is inserted into the open end of injector assembly housing 1004 atop the deck of tub wall 6A (see FIG. 17).

Figure 19:
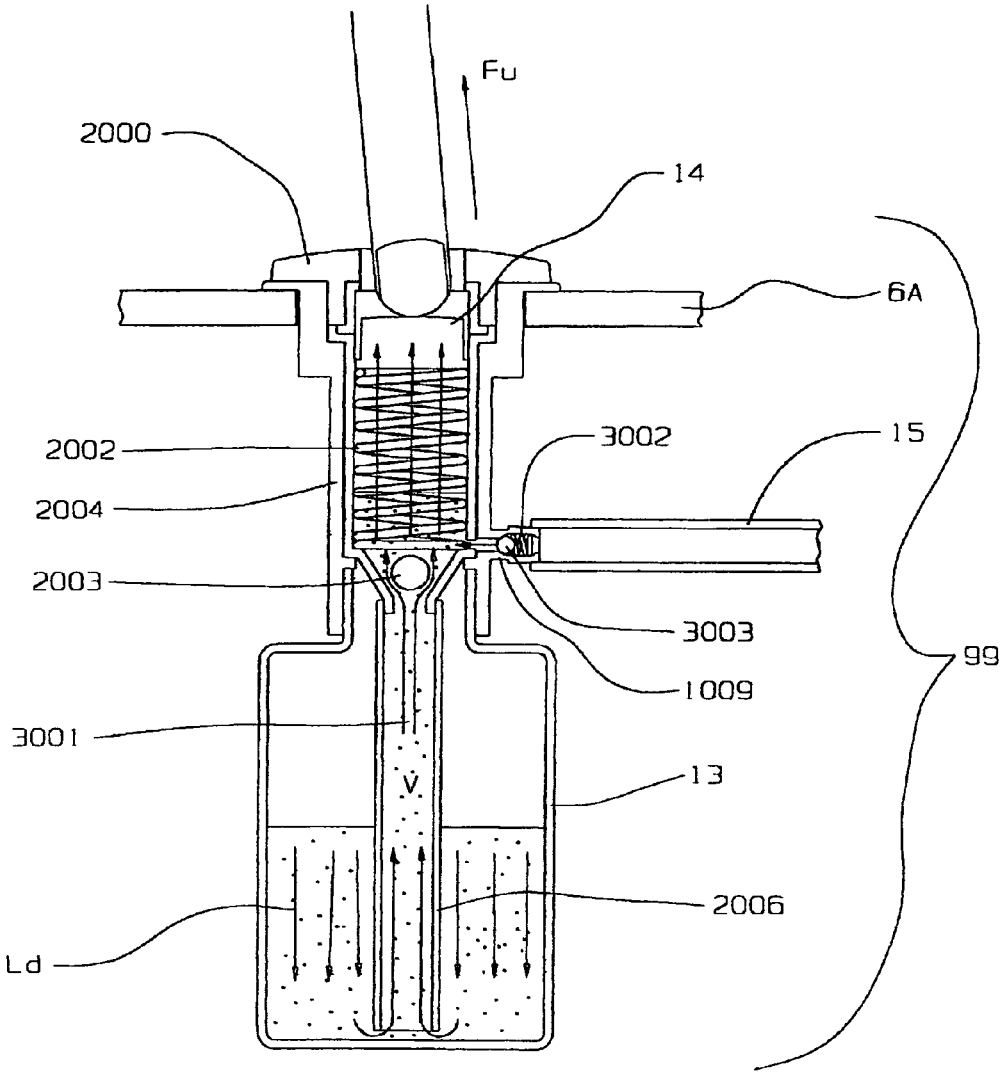
FIG. 19 is a longitudinal sectional view of the deck mount top fill dispenser of FIG. 17 and one embodiment of a antimicrobial liquid reservoir.

FIG. 19 is a longitudinal sectional view of the deck mount top fill dispenser 99 of FIG. 17 and one embodiment of a antimicrobial liquid reservoir 13. FIG. 19 shows that initially there is no antimicrobial liquid 3001 in antimicrobial line 15 connected to inner tube injector port 1009. As user depresses injector button 14 in direction F.sub.d (See (FIG. 20), spring 2002 within pick up housing 2004 compresses in direction P.sub.d. FIG. 19 shows that as user releases injector button 14 in direction F.sub.u, spring 2002 expands unseating check ball 2003 and causing vacuum V to draw antimicrobial liquid 3001 into antimicrobial pick up tube 2006. As vacuum V draws antimicrobial liquid 3001 up around check ball 2003, antimicrobial liquid 3001 within reservoir 13 moves in direction L.sub.d. A second check ball 3003 and spring 3002 reside within inner tube injector port 1009 (see also FIGS. 21, 22, 22A) preventing antimicrobial liquid 3001 from entering antimicrobial line 15.

Figures 20, 21:
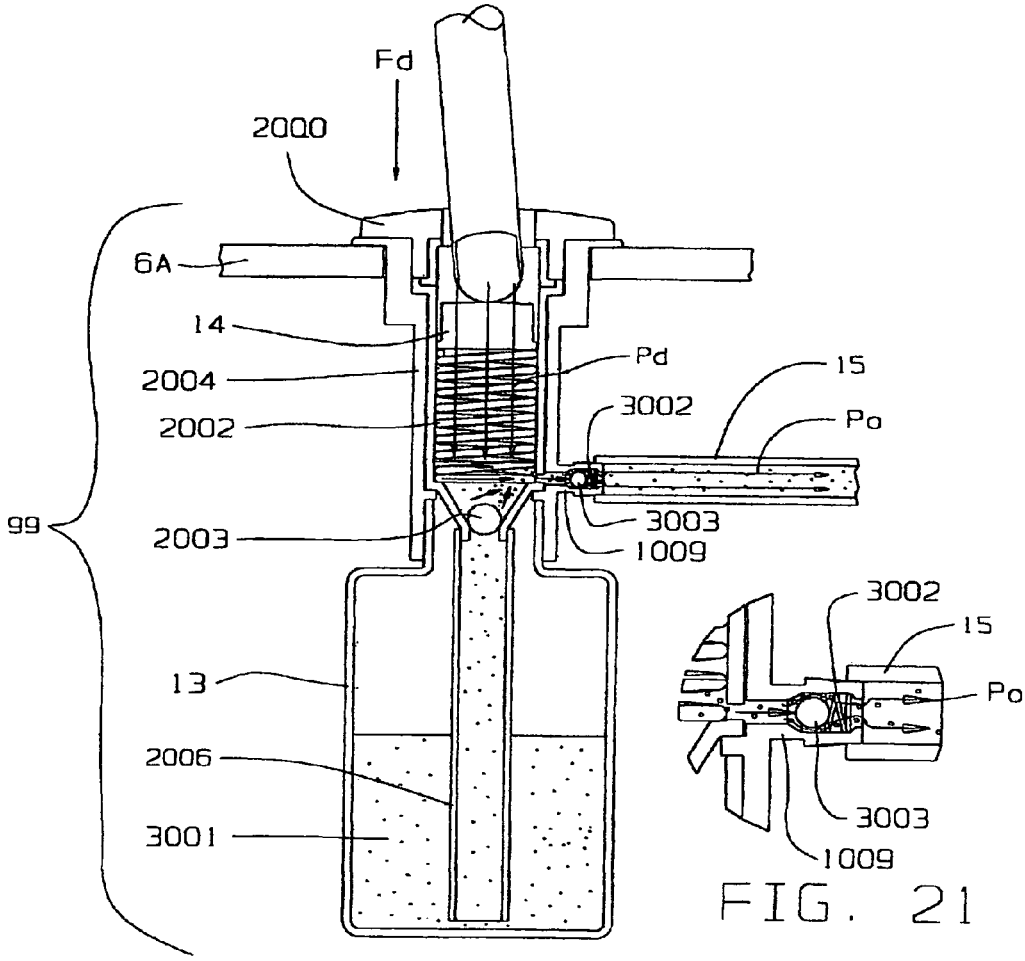
FIG. 20 is the same view as FIG. 19, wherein the injector button is depressed and antimicrobial liquid is dispensed into the water vessel system.
FIG. 21 is a close up plan view of the liquid pressure directing assembly of the dispenser for antimicrobial liquids shown in FIG. 20.

FIG. 20 is the same view as FIG. 19, wherein the injector button is depressed, thereby causing antimicrobial liquid 3001 entering antimicrobial line 15 to be dispensed into the water vessel system.

As user depresses injector button 14 in direction F.sub.d, spring 2002 within pick up housing 2004 compresses in direction Pd. Check ball 2003 reseats and holds antimicrobial liquid 3001 in reservoir 13 and antimicrobial pick up tube 2006 while spring 3002 compresses unseating check ball 3003. Antimicrobial liquid 3001 which was drawn past check ball 2003 as shown in FIG. 19, may now move past check ball 3003 in direction P.sub.o to enter antimicrobial line 15 to be dispensed in the water vessel system. FIG. 21 provides a close up view of the antimicrobial liquid movement into antimicrobial line 15 as shown in FIG. 20.

Figure 22B:
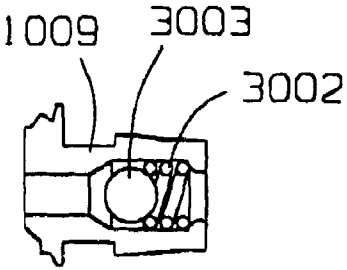
FIG. 22B is a close up sectional view of the inner tube injector port with the port open, thereby allowing antimicrobial liquids to enter the water vessel system.
Figure 22A:
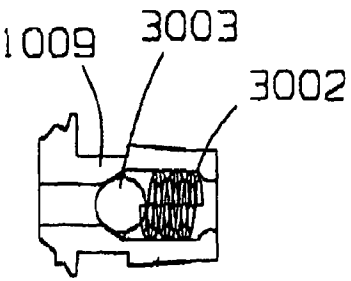
FIG. 22A is a close up sectional view of the inner tube injector port with the port closed.
Figure 22:
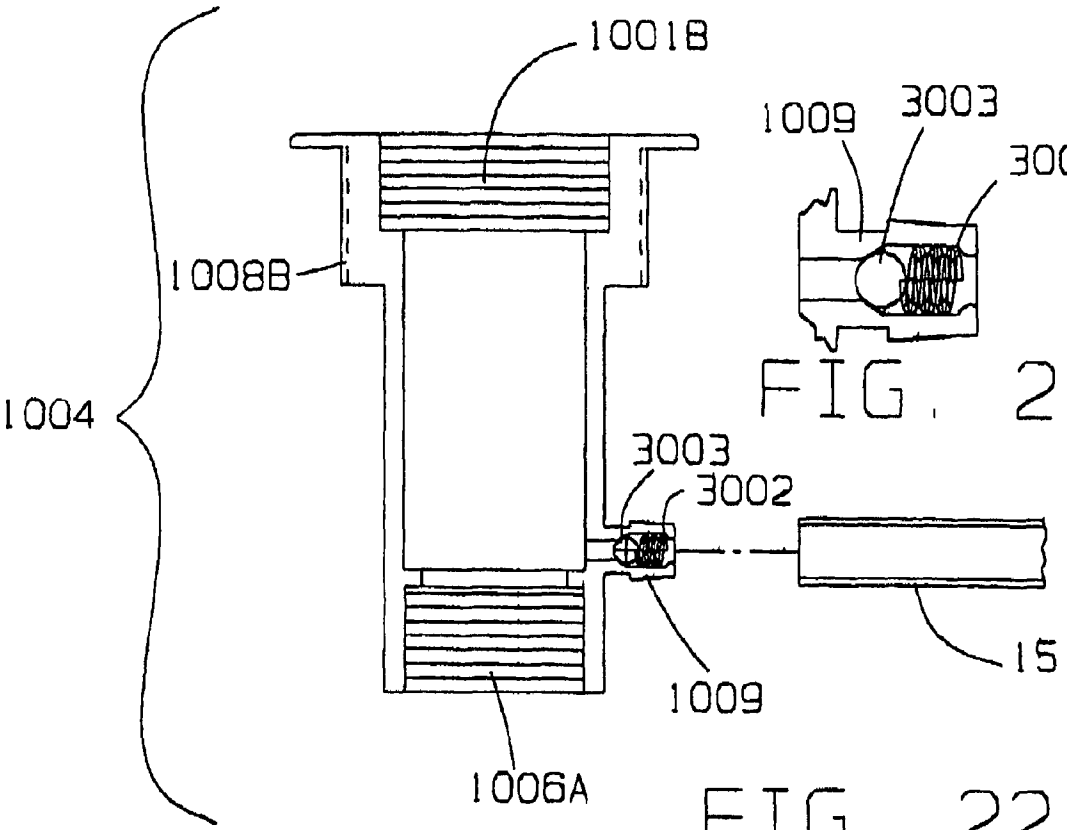
FIG. 22 is a sectional view of the injector assembly housing shown in FIG. 17.

FIGS. 22, 22A, 22B show the inner tube injector port 1009 of injector assembly housing 1004 to which antimicrobial line 15 is connected. Check ball 3003 and spring 3002 residing within inner tube injector port 1009 prevents antimicrobial liquid 3001 from entering antimicrobial line 15 when the port 1009 is "closed." The injector port 1009 is closed when check ball 3003 is seated as shown in FIG. 22A. When the injector port 1009 is "open," antimicrobial liquid 3001 may enter antimicrobial line 15. The injector port 1009 is open when check ball 3003 is unseated as shown in FIG. 22B.

Although the present invention has been described with reference to disclosed embodiments, numerous modifications and variations can be made and still the result will come within the scope of the invention. No limitation with respect to the specific embodiments disclosed herein is intended or should be inferred.

We claim:

1. A method of making a fill and drain whirlpool bathtub having a tub, a closed loop plumbing system, an inlet pipe, an outlet pipe, a wall fitting and a water pump, the method comprising the steps of:

providing the tub having a sloped sidewall;

providing the inlet pipe made of a material having an antimicrobial therein;

providing the outlet pipe made of a material having an antimicrobial therein;

providing the wall fitting made of a material having an antimicrobial therein;

providing the water pump made of a material having an antimicrobial therein;

assembling the tub, the inlet pipe, the outlet pipe, the wall fitting, and the water pump to form the closed loop plumbing system for water flow; and wherein the antimicrobial is of sufficient concentration and type to provide for bacteria reduction in the closed loop plumbing system where the bacteria contacts the antimicrobial, after tub drain down and between electrical system activation.

2. The method of claim 1, wherein the whirlpool bathtub is configured to retain less than 10½ ounces of water after tub drain down.

3. The method of claim 1, wherein the whirlpool bathtub is configured to retain less than 6½ ounces of water after tub drain down.

4. The method of claim 1, wherein the whirlpool bathtub is configured to retain less than 4 ounces of water after tub drain down.

5. The method of claim 1, wherein the tub surface is made of a material having an antimicrobial therein.

6. The method of claim 1, wherein the air controls is made of a material having an antimicrobial therein.

7. The method of claim 1, wherein the antimicrobial provides for optimum protection from bacteria.

8. The method of claim 1, wherein the fiberglass reinforced backing is made with an antimicrobial therein.

9. A method of making a fill and drain whirlpool bathtub having a tub, a closed loop plumbing system, an inlet pipe, an outlet pipe, a suction fitting, a jet fitting and a water pump, the method comprising the steps of:

providing the tub having a sidewall;

providing the inlet pipe made of a material having an antimicrobial therein;

providing the outlet pipe made of a material having an antimicrobial therein;

providing the suction fitting made of a material having an antimicrobial therein;

providing the jet fitting made of a material having an antimicrobial therein;

providing the water pump made of a material having an antimicrobial therein;

assembling the tub, the inlet pipe, the outlet pipe, the suction fitting, the jet fitting and the water pump to form the closed loop plumbing system for water flow; and wherein the antimicrobial is of sufficient concentration and type to inhibit bacteria growth in the closed loop plumbing system where the bacteria contacts the antimicrobial, after tub drain down and between electrical system activation.

10. A method of making a fill and drain whirlpool bathtub having a tub, a closed loop plumbing system, an inlet pipe, an outlet pipe, a wall fitting, an air pipe and a water pump, the method comprising the steps of:

providing the tub having a sidewall;

providing the inlet pipe made of a material having an antimicrobial therein;

providing the outlet pipe made of a material having an antimicrobial therein;

providing the wall fitting made of a material having an antimicrobial therein;

providing the water pump made of a material having an antimicrobial therein;

providing the air pipe made of a material having an antimicrobial therein;

assembling the tub, the inlet pipe, the outlet pipe, the wall fitting, the air pipe and the water pump;

wherein the tub, the inlet pipe, the outlet pipe, the wall fitting and the water pump form the closed loop plumbing system for water flow; and wherein the antimicrobial is of sufficient concentration and type to inhibit bacteria growth in the closed loop plumbing system where the bacteria contacts the antimicrobial, after tub drain down and between electrical system activation.

* * * * *